US009433872B2

(12) United States Patent
Rodstein

(10) Patent No.: US 9,433,872 B2
(45) Date of Patent: Sep. 6, 2016

(54) BUILDING BLOCK CONSTRUCTION SYSTEM

(71) Applicant: Daniel Ryan Rodstein, Los Angeles, CA (US)

(72) Inventor: Daniel Ryan Rodstein, Los Angeles, CA (US)

( * ) Notice: Subject to any disclaimer, the term of this patent is extended or adjusted under 35 U.S.C. 154(b) by 0 days.

(21) Appl. No.: 14/622,667

(22) Filed: Feb. 13, 2015

(65) Prior Publication Data

US 2015/0290550 A1 Oct. 15, 2015

Related U.S. Application Data

(60) Provisional application No. 61/940,031, filed on Feb. 14, 2014.

(51) Int. Cl.
*A63H 33/08* (2006.01)

(52) U.S. Cl.
CPC ..... *A63H 33/082* (2013.01)

(58) Field of Classification Search
USPC ..... 446/105, 108, 112, 115, 116, 117, 118, 446/124, 125; 273/156, 157 R, 153 P; 52/245, 249
See application file for complete search history.

(56) References Cited

U.S. PATENT DOCUMENTS 535,497 A * 3/1895 Herth ..... E04F 15/04 52/245
2,119,921 A * 6/1938 Levy ..... A63H 33/062 446/116
4,090,322 A * 5/1978 Hake ..... A63H 33/038 446/104
4,905,409 A * 3/1990 Cole ..... A01G 1/08 47/33
5,100,358 A * 3/1992 Volgger ..... A63H 33/08 446/104
5,823,531 A * 10/1998 Huber ..... A63F 9/1208 273/156
5,895,306 A * 4/1999 Cunningham ..... A63F 9/1288 446/102
6,022,172 A * 2/2000 Siyaj ..... E02B 3/108 405/110
6,142,848 A * 11/2000 Madner ..... A63H 33/04 446/107
6,186,855 B1 * 2/2001 Bauer ..... A63H 33/04 446/104
7,320,633 B2 * 1/2008 Park ..... A63H 33/046 446/131
8,464,476 B2 * 6/2013 Roberts ..... E02B 3/04 446/102
2008/0214087 A1 * 9/2008 Warner ..... A63H 33/108 446/124

* cited by examiner

*Primary Examiner* — Kurt Fernstrom
(74) *Attorney, Agent, or Firm* — Lowe Graham Jones PLLC

(57) ABSTRACT

A building system includes blocks having first and second side surfaces that are perpendicular to a common plane defining a subtended angle, couplers and receivers are defined in the first and second side surfaces such that chains of blocks may be coupled to one another in rows forming closed loops or non-closed chains. Rows may be coupled together by engaging core links with a block in each row and with a core rod passing through each row. Blocks in each row may include a peg and aperture engaging a corresponding aperture and peg in adjacent rows to facilitate alignment. Core rods threadably secure to other cord rods, slanted blocks, caps, and other feature blocks in order to capture a stack of rows in engagement with the core rods. Blocks including decorative features and forming parts of pivoting joints may also be included within a row.

11 Claims, 26 Drawing Sheets

BUILDING BLOCK CONSTRUCTION SYSTEM

PRIORITY CLAIM

This application claims the benefit of U.S. Provisional Application Ser. No. 61/940,031, filed Feb. 14, 2014, which is hereby incorporated herein by reference in its entirety.

FIELD OF THE INVENTION

This application is directed to building blocks used as children's toys and for building decorative figures.

BACKGROUND OF THE INVENTION

Various toy building systems currently exist which allow children to build toy structures. Commonly known building systems consist of a rectangular block with studs on the top, which fit into a hollow area on the underside of the subsequent block. These common building systems, known by the name Lego™ or Mega Blocks™ for example, allow children to build with rectangular type blocks, which result in a structure that may have a non-realistic appearance. Other building systems provide entertainment to children by allowing them to build structures with a rod and connector system, such as the K'Nex™ brand name product.

The building system disclosed herein provides an improved building system that provides for the building of more complex and imaginative structures than provided by previous building systems.

SUMMARY OF THE INVENTION

In one aspect of the invention, a building system includes a plurality of blocks having a hexahedral body. The hexahedral body includes first and second side surfaces that are perpendicular to a common plane and define a subtended angle in the common plane. The block further includes a coupler extending outwardly from the first side surface and a receiver extending inwardly from the second side surface into the hexahedral body, the receiver being sized to receive and removably retain the coupler. The plurality of blocks define non-zero subtended angles such that at least a portion of the plurality of blocks are positionable in a closed loop having the coupler of each block engaged with a receiver of an adjacent block. The subtended angles of the plurality of blocks may include a plurality of subtended angles.

The hexahedral body of each block may include front and back surfaces that extend between and intersect the first and second side surfaces. The front surfaces of the plurality of blocks may define a plurality of angles relative to the back surfaces thereof and the common plane.

In some embodiments, the coupler of each block includes an arm extending perpendicularly outward from the first side surface and a peg extending perpendicularly from a lower surface of the arm parallel to the common plane, the arm further defining an upper surface opposite and parallel to the lower surface. The hexahedral body may include a top surface parallel to the common plane and intersecting the first and second side surfaces. The receiver may include (a) a slot including (i) slot side surfaces extending into the hexahedral body perpendicular to the second side surface and to the common plane and (ii) a slot bottom surface extending into the hexahedral body perpendicular to the second side surface and parallel to the common plane and (b) a hole extending inwardly from the slot bottom surface into the hexahedral body. The arm and peg are sized such that the arm and peg are positionable within the slot and hole, respectively, of an adjacent block of the plurality of blocks having the upper surface of the arm flush with the top surface of the adjacent block.

In some embodiments, the plurality of blocks is a plurality of basic blocks and the system further includes a plurality of other blocks including a plurality of A blocks, a plurality of B blocks, and a plurality of C blocks.

Each A block may include a hexahedral body having first and second side surfaces that are perpendicular to a common plane and define a subtended angle in the common plane. A first coupler extends perpendicularly away from the first side surface, the first coupler being sized to removably insert within the receivers of the basic blocks. A second coupler extends perpendicularly away from the second side surface. A coupling element may appear at the top and bottom surfaces including an aperture or peg.

Each B block may include a hexahedral body having first and second side surfaces that are perpendicular to a common plane and define a subtended angle in the common plane. A first receiver extends into the hexahedral body perpendicular to the first side surface, the first receiver sized to removably receive the second couplers of the A blocks. The first receiver has a B width parallel to the first side surface and common plane that is wider than a basic width of the receiver of the basic blocks parallel to the second side surface and common plane of the basic blocks. A second receiver extends into the hexahedral body perpendicular to the second side surface, the second receiver sized to removably receive the couplers of the basic blocks and the first couplers of the A blocks.

Each C block may include a hexahedral body having first and second side surfaces that are perpendicular to a common plane and define a subtended angle in the common plane. A coupler extends perpendicularly away from the first side surface, the coupler being sized to removably insert within the receivers of the basic blocks for example. A receiver extends into the hexahedral body perpendicular to the second side surface, the receiver sized to removably receive the couplers of the basic blocks and C blocks and the first couplers of the A blocks, for example. The receiver has the C width parallel to the second side surface and common plane, the C width may be the same as for different from the B width.

The basic and A blocks are shaped such that a first semi circular member may be formed including a first chain of basic blocks coupled to one another having one of the A blocks coupled to a first end of the first chain, such that the second coupler of the one of the A blocks and the coupler of the basic block at a second end of the first chain are exposed.

The basic, B, and C blocks are shaped such that a second semi circular member may be formed including a second chain of basic blocks coupled to one another having one of the B blocks coupled to a first end of the second chain and one of the C blocks coupled to a second end of the second chain, the one of the C blocks having the receiver thereof positioned to receive the coupler of the basic block at the second end of the first chain and the first receiver of the one of the B blocks positioned receive the second coupler of the one of the A blocks of the first semi circular member.

The building system may further include blocks including a peg on one of a top and bottom surface and a corresponding aperture on the other of the top and bottom surface for securing adjacent rows to one another.

In some embodiments, the building system includes core rods and a plurality of D blocks. The D blocks may include a hexahedral body having first and second side surfaces that are perpendicular to a common plane and define a subtended angle in the common plane. A first coupling element includes one of (a) a first coupler extending from the first side surface and sized to insert within the receivers of the basic blocks and (b) a first receiver extending into the first side surface and sized to receive the couplers of the basic blocks. The D block further includes a link coupler and the system includes a plurality of core links. The core links define a first aperture sized to receive the one or more core rods and a block coupler configured to removably secure to the link coupler of the D blocks.

A method for using the building system is also disclosed and claimed herein.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1A:
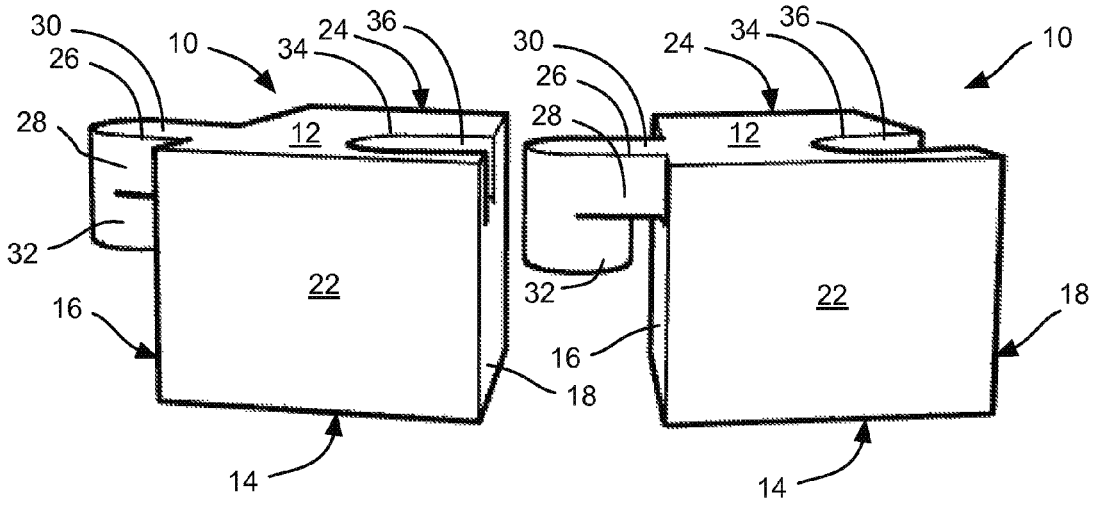
FIGS. 1A and 1B are isometric views of basic building blocks for a construction system in accordance with an embodiment of the present invention.

Current building systems have less desirable building and connection methods, which lack a resulting generally, rounded realistic appearance in the final built structure. It would appear more desirable, as set forth below in the invention, to create a building system that allows a child to build a structure that is somewhat round and creates an increased realistic appearance. In order to create figures like dinosaurs or animals, which have a more rounded appearance, a new building system is needed. New types of building blocks and connection systems are needed in order to create a resulting built structure that has a generally rounded realistic appearance.

The building system described herein may be used to create generally rounded shapes that enables the building of products, like dinosaurs or other contoured shapes, that require an at least somewhat rounded appearance to look more realistic. The unique shape of the building blocks, the building block connections, and the building system disclosed herein provides for the creation of circular, curved and round shaped rows, which when connected on top of one another creates realistic products such as animals, dinosaurs, robots, and the like. Additionally, other shaped figures, including those with rectilinear shapes or portions, can be created using the unique features of the system. Note that when referring to rows, discs, layers and other structures described herein as round or circular, they may be other than exactly circular. Instead, rows, discs, layers, and other structures may be generally circular or curved in at least a rough form. Such rows described as circular may generally be oval or egg shaped, within this general meaning of "rounded" as opposed to square or rectangular. Additionally, rows may be other than closed loops, such as a semi-circular row, or any other variation of a row that does not form a closed loop, i.e. the ends thereof are not connected together. This can be seen, for example, in the head and leg of the dinosaur shown in FIG. 23.

A series of unique block shapes, which have a unique geometric shape, are connected together to make various generally circular or disc-shaped rows. The series of building blocks needed to build various shaped circular rows result from adjusting the unique geometric shapes, and back slant walls of the basic blocks, and providing special blocks. The unique shaped blocks are then connected in a certain order using the peg connection system to form various circular shaped rows. Different circular shaped rows are created by connecting various combinations of blocks. The circular shaped rows are then stacked on top of each other, through a unique connection system, which elongates the figure being built enabling the creation of a product that is circular and round. The back slant wall of the blocks, that are visible on the outside of the resulting product, is angled in varying degrees either out, in or flat which contributes to the appearance of a smooth transition between rows.

The primary block connection system consists of two blocks connecting together, in the preferred embodiment, with a peg and arm on one block that is placed into the insertion hole on the second block. Complete circular shaped rows are preferably built in two halves using a unique connection system, the Transition System, which allows the two circular halves to be connected together creating a complete circular shaped row. Two elongated insertion holes are present on one half of the row and two pegs are present on the second half. The two halves are then connected together utilizing these unique blocks to create a round shaped row. Alternatively, in another variation, the two halves of a row are not utilized to finish connecting the complete row, and instead the row can be built in a circular fashion and can be connected utilizing some pieces of the transition system.

The elongated circular and round shape of the figure being built is created by stacking individual circular shaped rows on top of one another. Rows are positioned and connected to each other through a combination of the unique row positioning system using pegs and corresponding apertures as well as core rods linked to each row as described hereinbelow. The row positioning system consists of a peg on the bottom of one block on the upper row which is connected to an aperture on a block in the lower row. Other variations of the row positioning system can be created such as if the peg and aperture placement on the upper and lower row are reversed to achieve the same effect. Both the peg and aperture location are uniquely positioned on a specific block on each row. Proper configuration of the rows result when the rows are connected together and the peg is inserted into the hole.

In addition, the elongated circular structure being created can be angled to aid in the realistic presentation of a figure by the insertion of slant rows. Slant rows are inserted between rows in order to create a bend in the elongated figure. Slant rows are angled rows that tilt the direction of the figure being built.

In some embodiments, the building system utilizes a core rod connection system which secures the rows to one another and restricts movement. Preferably, every row has a core connector that attaches to a block that extends out into the open internal area inside the circular cavity. The core rod is then placed through the core connector. Rows are securely connected together when core rods, or other feature pieces, are fastened onto each other restricting movement of the rows. A starter core rod may be used on the first row of a figure and has unique features to align and secure the core rod.

The building system disclosed herein includes shaped building blocks, a building block connection system, and a building system which enables the builder to create generally rounded shapes, along with other shapes, and designs to create realistic products. The following information is a detailed description of the different components of the building block system.

Figure 1B:
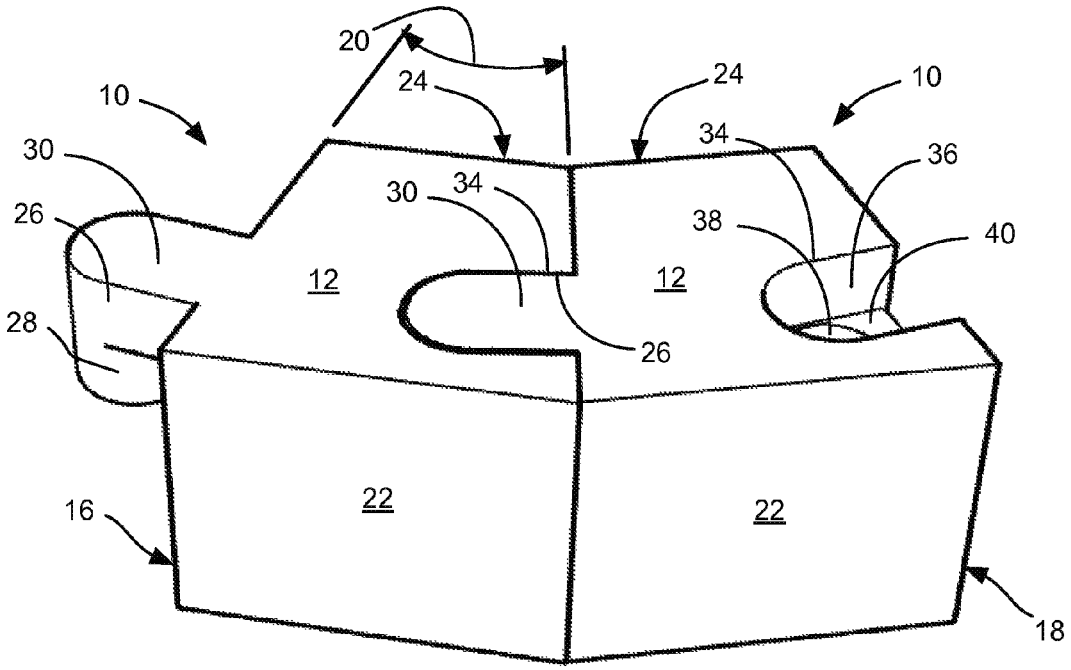

Referring to FIGS. 1A and 1B, a building system may include blocks 10 that may be understood to be basic blocks for forming a majority of the building system and/or performing a basic function in the building system. The blocks 10 may have a hexahedral shape that is non-cubic. For example, the blocks 10 may include a top surface 12 and a bottom surface 14 that are parallel to one another in some embodiments. Although the surfaces 12, 14 are referred to as top and bottom surfaces 12, 14, this is just for purposes of labeling and not a requirement for actual relative position of the top and bottom surfaces 12, 14 relative to one another.

The top and bottom surfaces 12, 14 are intersected by, e.g. share a common edge with, both a first side surface 16 and a second side surface 18 that are perpendicular to a common plane and define an angle 20 relative to one another, e.g. between 0 and 40 degrees. In some embodiments, the first side surface 16 and second side surface 18 are perpendicular to a plane parallel to the top and bottom surfaces. The building system includes a plurality of blocks 10 that may have a plurality of different angles 20.

The blocks 10 further include an outer surface 22 and an inner surface 24 that intersect, e.g. share a common edge with, all of the top, bottom, first side, and second side surfaces 12-18. The inner surface 24 may be perpendicular to one or both of the top and bottom surfaces 12, 14 and/or be perpendicular to the same plane to which the side surfaces 16, 18 are perpendicular. The outer surface 22 may be non-parallel to the inner surface 24 and non-perpendicular to some or all of the top and bottom surfaces 12, 14 and the same plane to which the side surfaces 16, 18 are perpendicular. In particular, the outer surface 22 may define an angle that contributes to an assembled figure having a contoured surface due to the non-parallel and non-perpendicular angle of the outer surface 22.

The outer surface 22 may face outwardly from a completed model whereas the inner surface 24 faces inwardly and may not be exposed in a completed model. Although the surfaces 22, 24 are designated as outer and inner, this is exemplary only and the outer surface 22 and inner surface 24 may in fact face inwardly and outwardly, respectively, in some applications.

Some or all of the surfaces 12, 14, 16, 18, 22, and 24 may bear numbers, symbols, or other indicia that identify the type of the block or uniquely identify the block. For example, the number, symbol, or other indicia may be printed, stamped, or molded onto an inner surface 24 or side surface 16, 18 such that it is not visible in a completed model.

The blocks 10 include an arm 26 protruding from one of the side surfaces 16, 18, e.g. the first side surface 16 in the illustrated embodiment. The arm 26 may protrude perpendicular to the first side surface 16 as shown. For example, the arm 26 may include surfaces 28 that extend both perpendicular to the same plane as the first side surface 16 and parallel to that plane such that the extent of the surfaces 28 parallel to that plane is perpendicular to the extent of the first side surface 16 parallel to that plane. The arm 26 further includes a top surface 30 that intersects the surfaces 28. A peg 32 extends from the arm 26 opposite the top surface.

On an opposite side of the block 10 to the arm 26 a slot 34 may be defined extending into the block 10 perpendicular to the second side surface 18. For example, the slot 34 may include sides 36 that extend both perpendicular to the same plane as the second side surface 18 and parallel to that plane such that the extent of the sides 36 parallel to that plane is perpendicular to the extent of the second side surface 18 parallel to that plane. The slot 34 may further include an aperture 38 that extends into the block 10 from a bottom surface 40 of the slot 34. The bottom surface of the slot may be perpendicular to the sides 36 of the slot 34.

As shown in FIG. 1B, the slot 34 and aperture 38 of a first block 10 may be sized to receive the arm 26 and peg 32 of a second block 10 of an adjacent block such that the second side surface 18 of the first block is facing and/or contacting the first side surface 16 of the second block. Specifically, the slot 34 and aperture 38 may be sized such that some or all of the sides 36, aperture 38, arm 26 and peg 32 must elastically deform in order for the arm 26 and peg 32 to be inserted within the slot 34 and aperture 38 thereby removably retaining the arm 26 and peg 32 within the slot 34 and aperture 38. In some embodiments, grooves or ridges on the arm 26 and/or peg 32 may engaged ridges or grooves, respectively, on the slot 34 and/or aperture 38 in order to elastically retain arm 26 and/or peg 32. The amount of deformation required to insert the arm 26 and peg 32 into the slot 34 and aperture 38 is preferably small enough to be exerted by a child and such that removal may also be performed by a child.

As shown in FIG. 1B, the top surface 30 of the arm 26 may be flush with the top surface 12 of the block 10 with which it is engaged. However, the top surface 30 may also be recessed below the top surface 12 in some embodiments.

Although the illustrated embodiment shows an arm 26 and peg 32 engaging a slot 34 and aperture 38 to removably secure blocks 10 to one another, other embodiments may also be used. Stated differently, a coupler on the first side surface 16 may engage any receiver defined by the second side surface 18 in order to removably secure adjacent blocks to one another. For example, a peg protruding from the first side surface 16 of a block 10 may simply insert within an aperture extending into the second side surface 18 of an adjacent block and be retained therein by biasing forces exerted by the peg or adjacent block 10. Likewise an arm 26 and peg 32 may have various configurations engaging a slot 34 and aperture 38 having a complementary shape for receiving the arm 26 and peg 32 in some embodiments. For example, the arm 26 may be cylindrical or some other shape rather than having flat surfaces 28. The slot 34 may likewise include a cylindrical surface for engaging the arm 26 rather than flat sides 36.

Figure 2C:
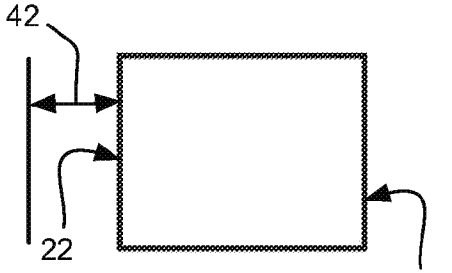
FIGS. 2A to 2C illustrate basic blocks having outer surfaces of various angles in accordance with an embodiment of the present invention.
Figure 2B:
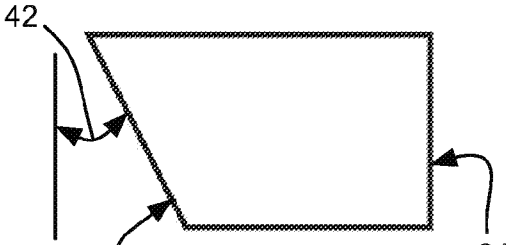
Figure 2A:
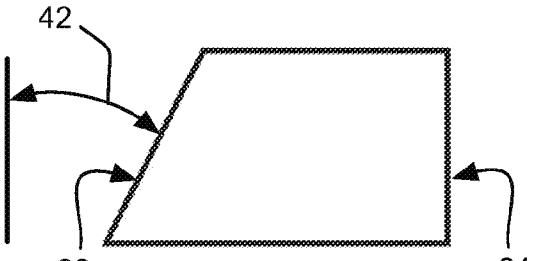
Figure 3E:
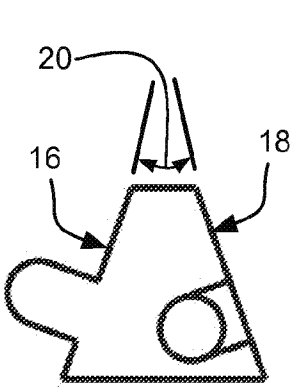
FIGS. 3A to 3E illustrate basic blocks having side surfaces defining various angles in a common plane with respect to one another in accordance with an embodiment of the present invention.
Figure 3D:
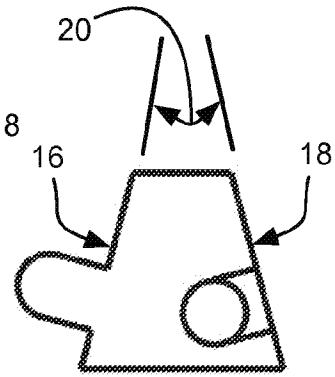
Figure 3C:
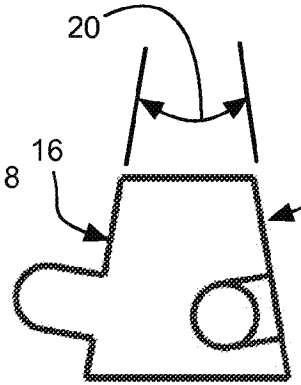
Figure 3B:
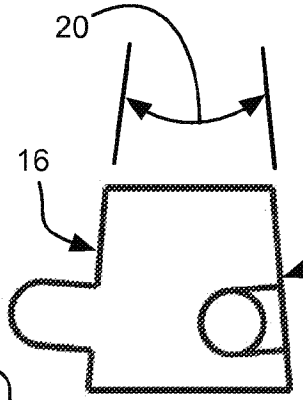
Figure 3A:
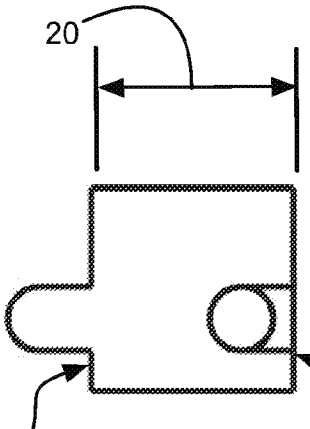

Referring to FIGS. 2A to 2C, as noted above the outer surface 22 may define a non-zero angle relative to the inner surface 24 and may define a non-perpendicular angle 42 relative to the top and bottom surfaces 12, 14 and to the common plane to which the side surfaces 16, 18 are perpendicular. This angle 42 may define a downward slant (FIG. 2A) or an upward slant (FIG. 2B). The building system may include blocks 10 having a plurality of different angles 42 to facilitate the forming of various contours using the blocks 10.

Figure 23:
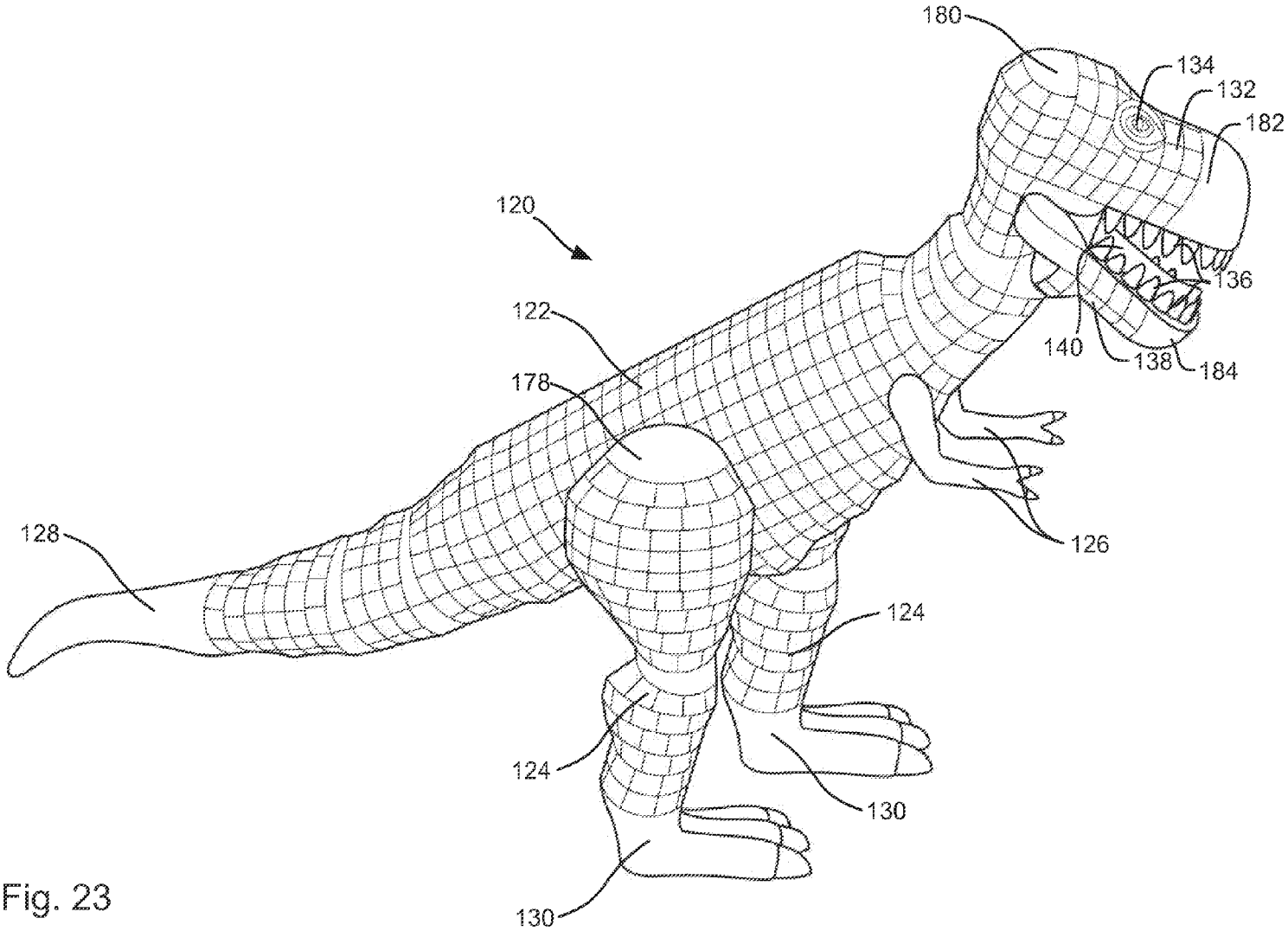
FIG. 23 illustrates an example of a figure that may be constructed using the building system in accordance with an embodiment of the present invention.
Figure 24:
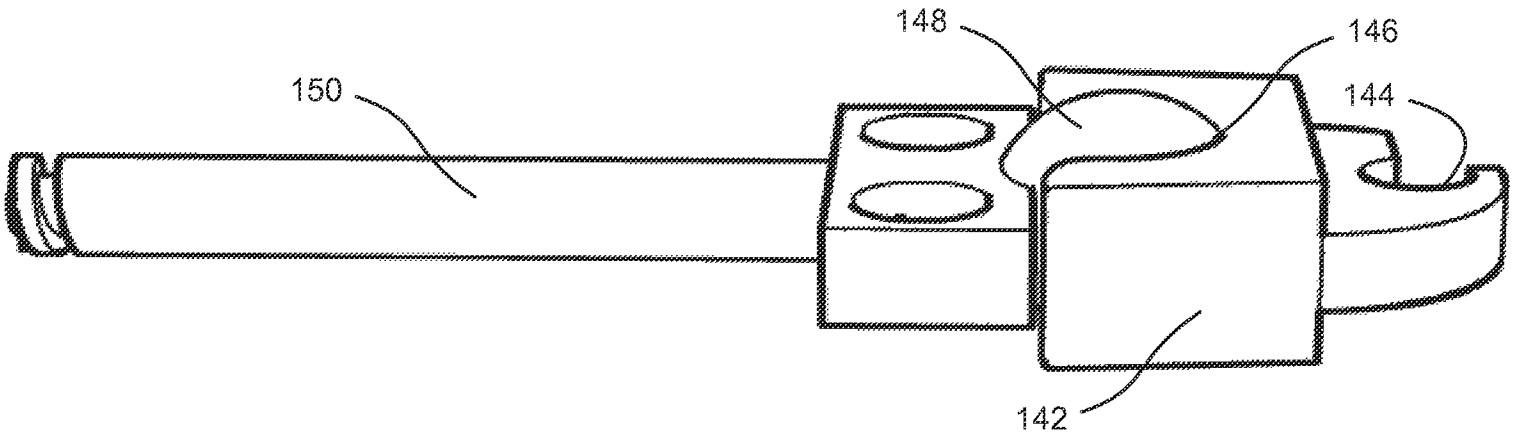
FIG. 24 illustrates a pivoting jaw joint for a figure in accordance with an embodiment of the present invention.

The different slant angles 42 of the outer surface 22 contributes to obtaining the appearance of a smooth transition when rows are stacked on top of each other, see, e.g. the figure of FIG. 23. The shape of the object being built appears to expand, contract, or remain constant, along the stacking direction of rows of blocks. The appearance of a figure being built expands when a series of rows are stacked on top of each other and the circumference of each row increases. Conversely, the appearance of a figure contracts when a series of rows are stacked on top of each other and the circumference of each row decreases. The slant angles 42 of the outer surfaces 22 of the blocks play a role in obtaining the expanding or contracting effect and providing for smooth transitions.

There are many variations of the degree of the slant angles 42 of the outer surface 22 of the blocks 10, as shown in FIGS. 2A to 2C. Some blocks have a small slant angle 42 and others have a large slant angle 42. Varying degrees of slant angles 42 may be used in order to blend rows together. In some instance a zero slant angle 42 is needed, and a flat outer surface 22 is used. In addition to the effect on the appearance of the figure, varying the slant angles 42 also changes the size of the block. This may also aid in the connection process in the transition system.

Referring to FIGS. 3A to 3E, as also noted above the first and second side surfaces 16 and 18 may be perpendicular to a common plane and define an angle 20 in that plane. As shown in FIGS. 3A to 3E, the building system may include blocks 10 defining a plurality of different angles 20 to facilitate the definition of various contours using the blocks 10. For example, the angle 20 is zero degrees in FIG. 3A, 10 degrees in FIG. 3B, 20 degrees in FIG. 3C, 30 degrees in FIG. 3D, and 40 degrees in FIG. 3E. Of course, other values of the angle 20 may be used between 5 and 45 degrees, between 10 and 40 degrees, or some other range of angles 20.

Although in the illustrated embodiment, there are five different Basic Block geometric shapes that are used to form the shape of every row. Basic blocks 10 having many more geometries, e.g. angles 20, may be used.

As is apparent in FIGS. 3A to 3E, the top and bottom surfaces 12, 14 are quadrilateral, e.g. trapezoidal, rather than coming to a point to form a triangle, e.g. extending the side surface 16, 18 until the inner surface 24 goes to a point. The quadrilateral shapes defined by the top and bottom surfaces 12, 14 enable blocks 10 to fit next to each other and form rows forming closed loops, including circular rows. Furthermore, the quadrilateral shape of the top and bottom surfaces 12, 14 provides for an internal cavity to form allowing the use of a core rod fastening system as described hereinbelow.

As already noted, the angles 20 of the basic blocks 10 enable them to be fastened to one another in order to make a row of blocks forming a closed loop, e.g. a circular row. For example, the angles 20 of the blocks 10 in a row may be equal to 360 degrees in order to form a closed loop. In alternate embodiments, the combined angles of blocks 10 in a row can deviate from 360 degrees to create other shaped rows, including rows that do not form closed loops and/or include indentations.

Figure 4B:
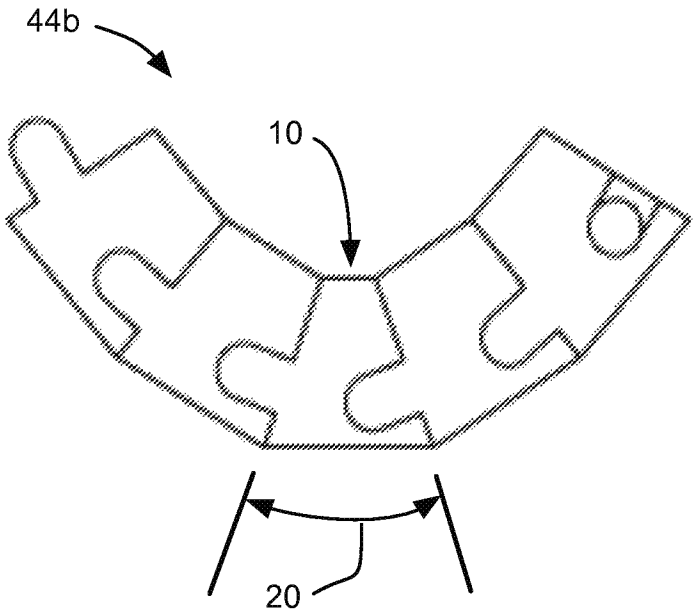
FIGS. 4A and 4B illustrate forming rows of various radii of curvature in accordance with an embodiment of the present invention.
Figure 4A:
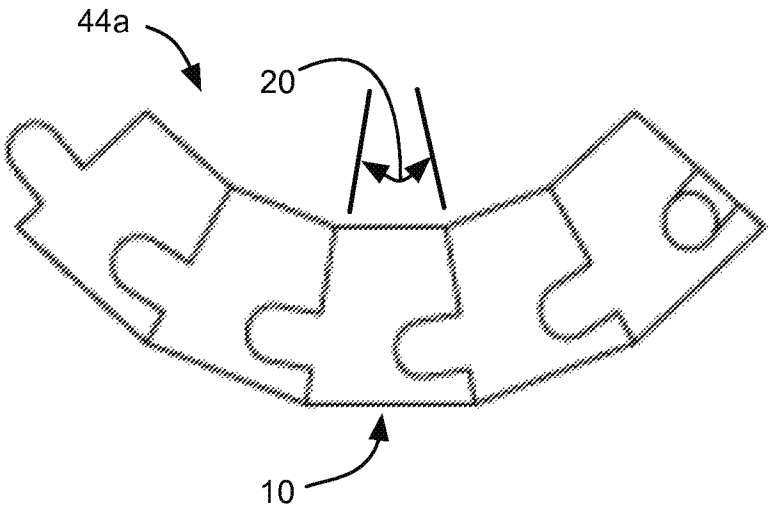

Referring to FIGS. 4A and 4B, using the blocks 10 having various angles 20, arcs 44*a*, 44*b* may be formed by joining the blocks together. For example, the center block 10 of FIG. 4A has a smaller angle 20 than the center block 10 of FIG. 4B resulting in a larger radius of curvature for arc 44*a* than for arc 44*b*.

The shape of the row formed by the blocks 10 is controlled by the type of blocks 10 selected, e.g. the angles 20 of the blocks 10, and changes when different shaped blocks are placed next to each other. A row can be built wider or narrower based on the combination of block shapes selected. As the number of blocks 10 in a row increases or decreases the shape of the row also changes. The shapes of the blocks selected play a direct role in controlling the shape of the resulting row. For example, as seen in FIG. 4A, there are five of the same shaped blocks 10 placed next to each other. If the middle block is changed to a different shaped block as shown in FIG. 4B, the shape of the figure being built will change. The new figure of FIG. 4B becomes more curved and narrower than the figure of FIG. 4A.

Block shapes may be specifically selected to be placed next to each other in every row to obtain the curvature desired in the final figure. The appearance of a row changes with different combinations of block shapes. In order to blend rows together, specific blocks are placed next to each other to form a row that will be able to also blend with the rows above and below. As rows are stacked on top of each other, the curvature of every row may be gradually changed in order to obtain a final figure that blends together. If a gradual blend is not necessary in the figure being built, other appearances are possible as well. For example, if the curvature of a first row of blocks 10 is wide, the curvature of a second row of blocks 10 cannot be narrow or the two rows will not mesh and blend together.

Figure 5A:
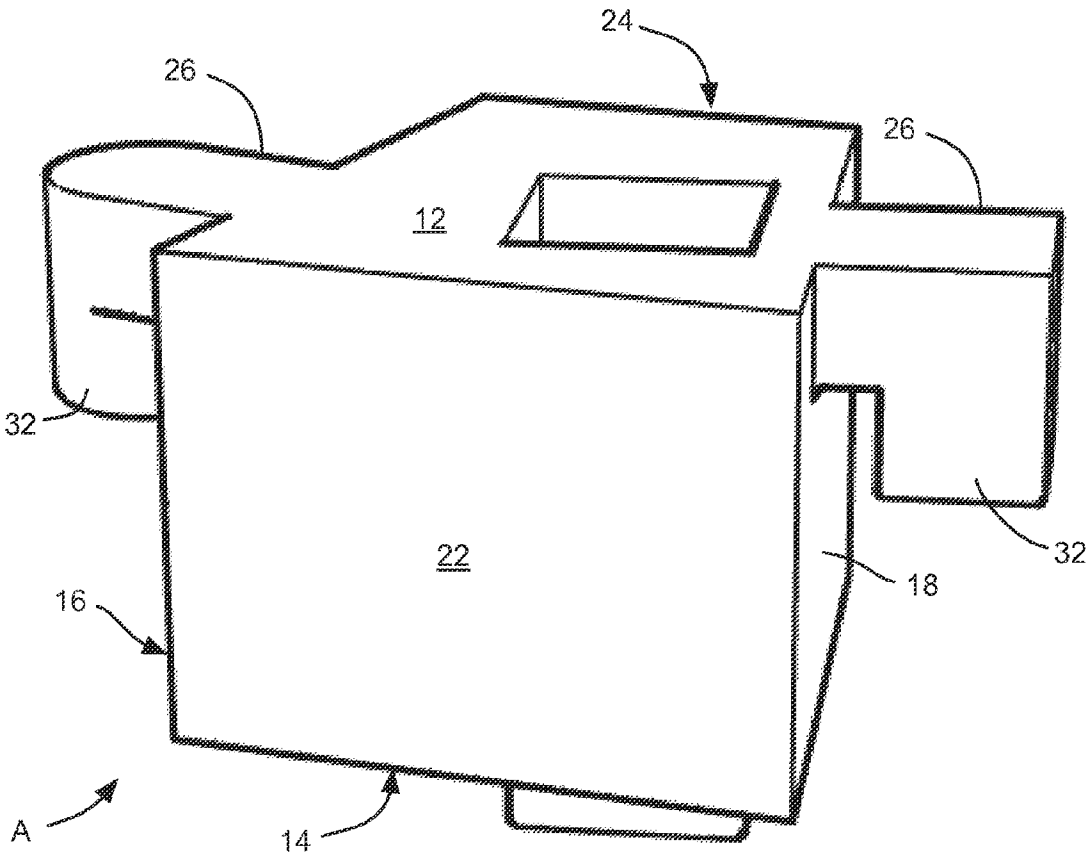
FIGS. 5A to 5C illustrate other blocks that may be used in a building system in accordance with an embodiment of the present invention.
Figure 5B:
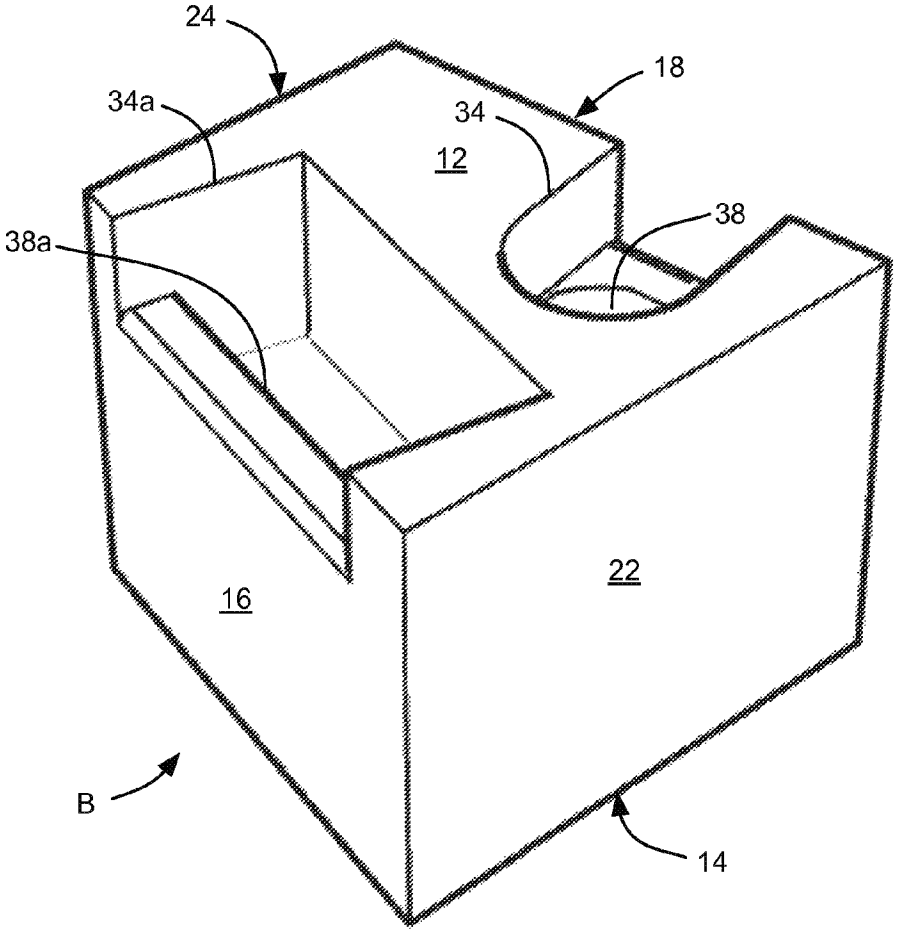
Figure 5C:
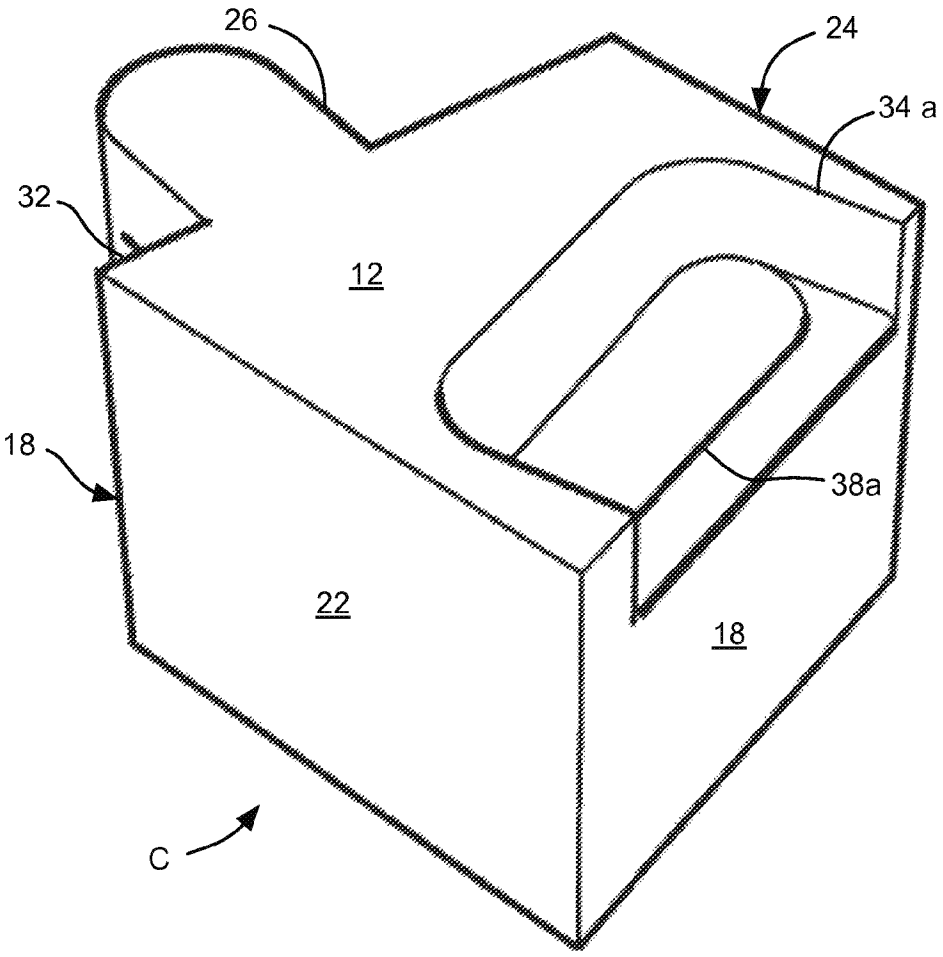

The building system may further include some or all of blocks A, blocks B, and blocks C shown in FIGS. 5A to 5C, respectively, that are identical to the basic blocks 10 except for the differences noted below. The blocks A, B, C may have various angles 20 between the side surfaces 16, 18 thereof and various outer face angles 42 as for the blocks 10. The blocks A, B, and C may collectively be referred to as a "Transition System" used to secure different portions of a row of blocks to one another to form a closed loop as described below.

Block A may be identical to block 10 except for an arm 26 and peg 32 emanate from the second side surface 18 in the same manner as for the first side surface 16 as described above with respect to the basic block 10. The block A may further lack the slot 34 and aperture 38 of the block 10. In the illustrated embodiment, the peg 32 on the second side surface 18 of the block A is square rather than round as for the peg 32 of the block 10 and the peg 32 located on the first side surface of the block A.

The block B may be identical to a block 10 but include a slot 34*a* and aperture 38*a* that are similar to the slot 34 and aperture 38 of the block 10 except that they are wider than the corresponding slot 34 and aperture 38 of a block 10 and extend inwardly from first side surface 16 of the block, rather than the second side surface 18 as for the block 10. Likewise, the block B may include a slot 34 and aperture 38 that are identical to the slot 34 and aperture 38 of the block 10.

The block C may be identical to a block 10 except the slot 34 and aperture 38 are replaced by widened slot 34*a* and aperture 38*a*, the slot 34*a* and aperture 38*a* extending inwardly from the second side surface 18 as for the block 10.

The slot 34*a* and aperture 38*a* of blocks B, C may, for example, be between 1.5 times and 2.5 times wider than the slot 34 and aperture 38 of the block 10 as measured in a direction parallel to the common edge between (a) the side surface 16, 18 from which the slots 34, 34*a* extend inwardly and (b) the top surface 12 of the block 10, B, C intersected by that side surface 16, 18. As is apparent in FIGS. 5B and 5C, the slot 34*a* and aperture 38*a* of the block B have a rectangular shape corresponding to the square shape of the peg 32 of the block A whereas the slot 34*a* and aperture 38*a* of the block C have rounded shape corresponding to the round pegs 32 of the basic blocks 10 and blocks C. The widths of the slots 38*a* of the blocks B and C as defined above may be the same or different.

Figure 6B:
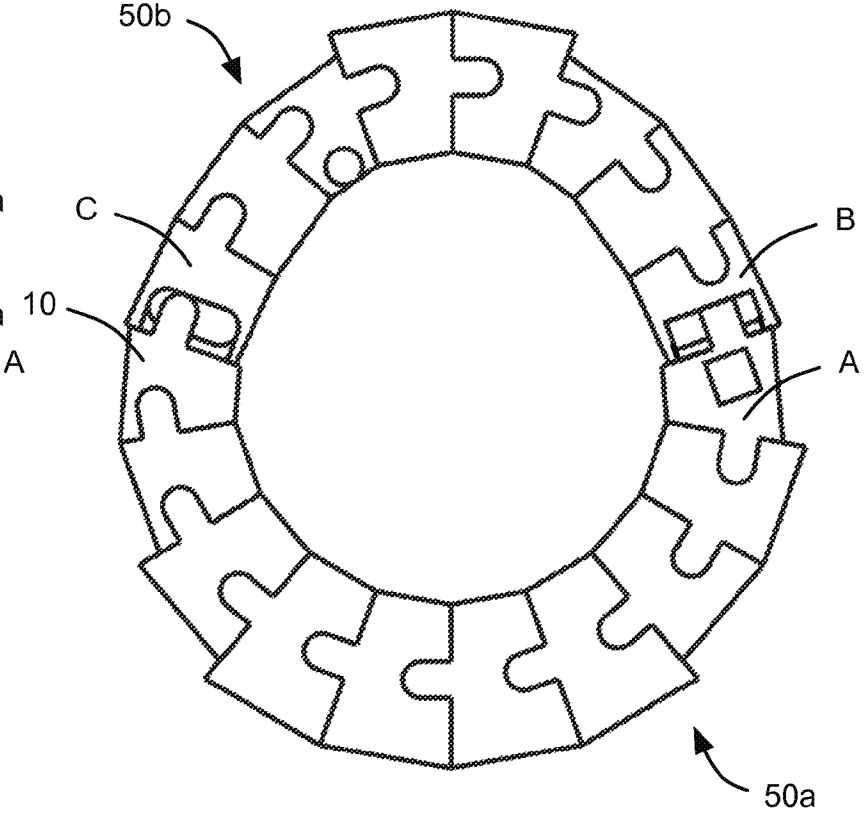
FIGS. 6A and 6B illustrate the attachment of two portions of a loop in accordance with an embodiment of the present invention.
Figure 6A:
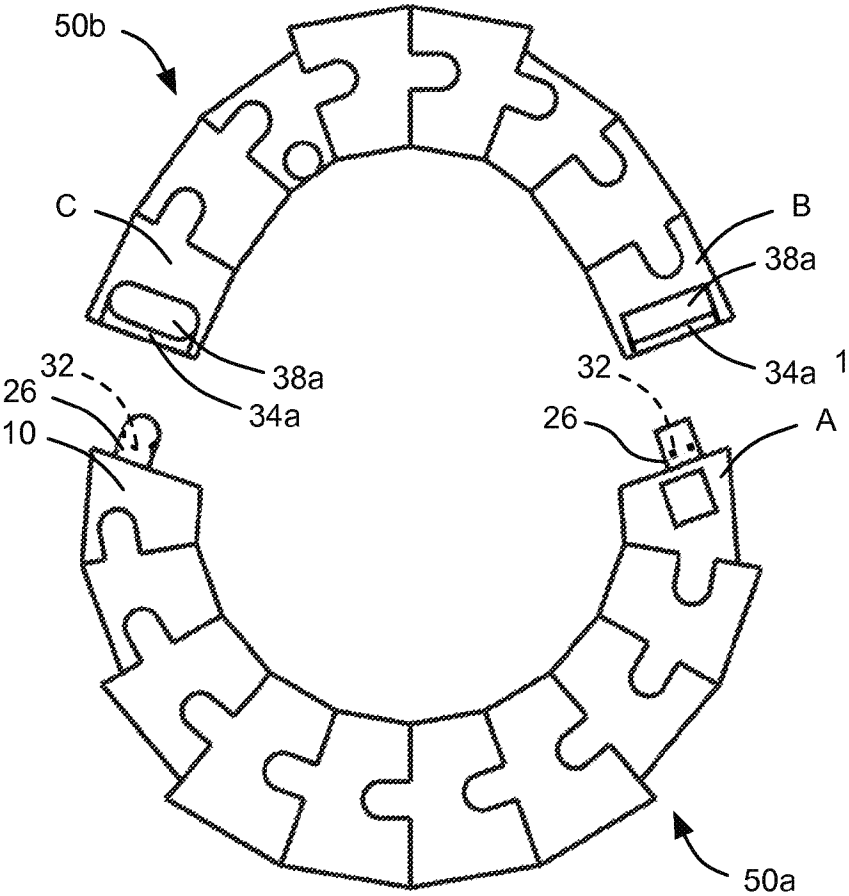

Referring to FIGS. 6A and 6B, blocks 10, A, B, C may be combined to form the illustrated arcs 50*a*, 50*b* that may be joined to form a ring. Specifically, arc 50*a*, may include a plurality of blocks 10 joined to form a chain having a block A at one end of the chain having an arm 26 and peg 32 exposed and a block 10 at the other end having an arm 26 and peg 32 exposed. Arc 50*b* may be formed of a chain of blocks 10 having a block B at one end and a block C at the other end.

To join the rings, the arm 26 and peg 32 of the block A are inserted into the slot 34*a* and aperture 38*a*, respectively, of the block B and the arm 26 and peg 32 are inserted into the slot 34*a* and aperture 38*a* of the block C. The additional width of the slots 34*a* and apertures 38*a* facilitates alignment and securement of the arcs 50*a*, 50*b*. In particular, due to the various combinations of angles 20 of the blocks 10, A, B, C forming the arcs 50*a*, 50*b* the locations of the arms 26 and pegs 32 exposed at the ends of the arc 50*a* may vary. The wider slots 34*a* and apertures 38*b* therefore accommodate this variation by accepting insertion at various positions.

Figure 7B:
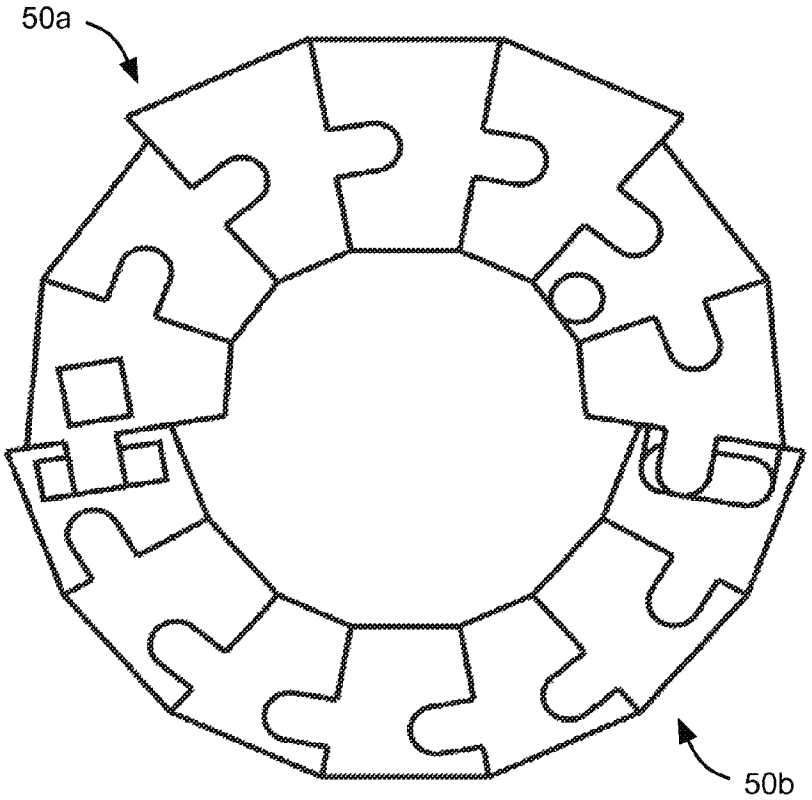
FIGS. 7A and 7B illustrate the proper alignment of two portions of a loop for attachment in accordance with an embodiment of the present invention.
Figure 7A:
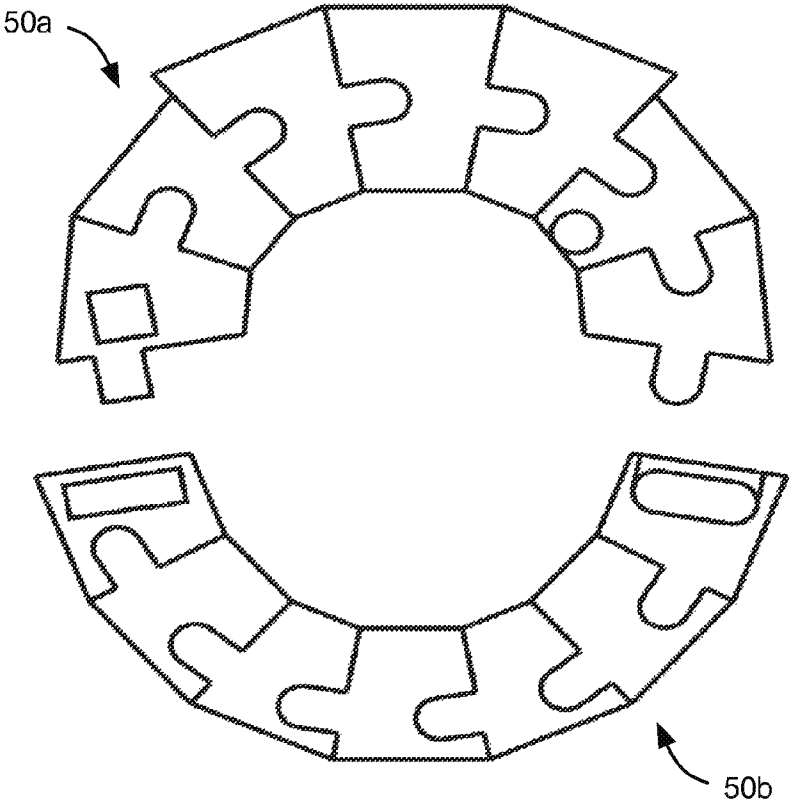

Referring to FIGS. 7A and 7B, arcs 50*a*, 50*b* should join together at at least one specific location. As seen in FIGS. 7A and 7B, when arc 50*a* is joined with the arc 50*b* it fits snugly and smoothly.

Figure 8B:
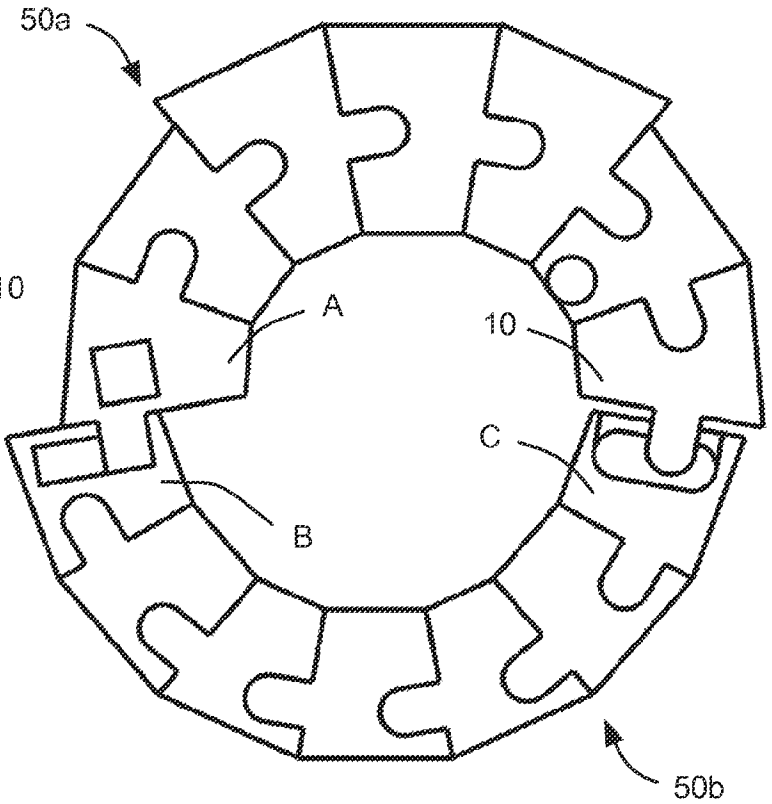
FIGS. 8A and 8B illustrate misalignment of two portions of a loop in accordance with an embodiment of the present invention.
Figure 8A:
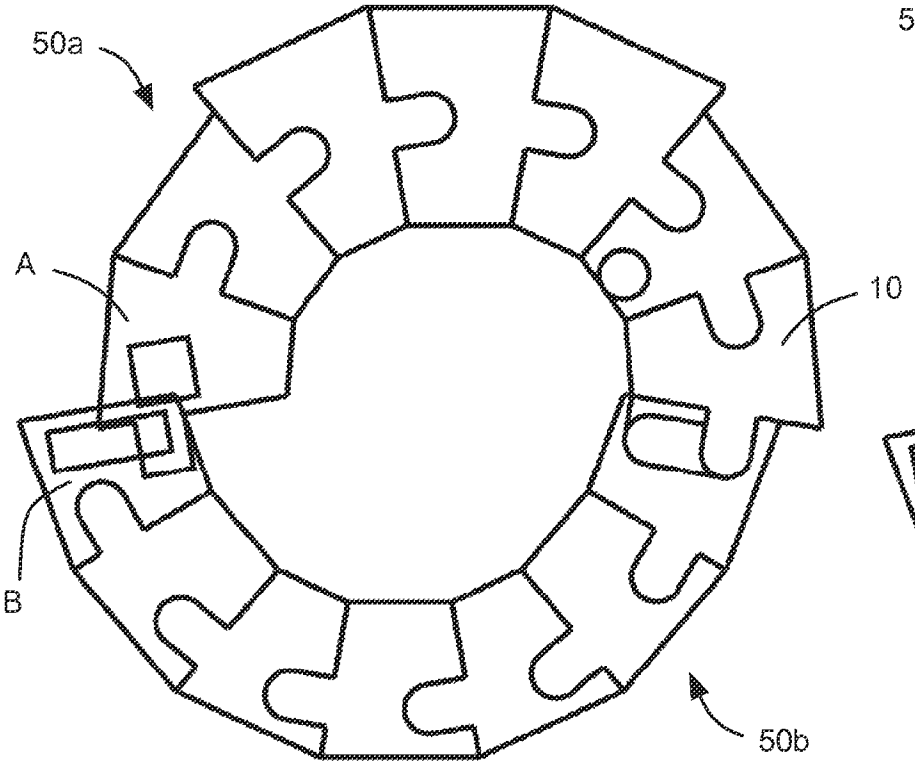

Referring to FIGS. 8A and 8B, if the user does not line up the arcs 50*a*, 50*b* in the correct manner they will not join together. FIGS. 8A and 8B show the two arcs 50*a*, 50*b* misaligned. The arcs 50*a*, 50*b* cannot be joined as shown in FIG. 8B because the block A of the arc 50*a* and the block B of the arc 50*b* will hit one another. In addition, if the two arcs 50*a*, 50*b* are joined in the other direction as shown in FIG. 8B, there will be a gap present between the two arcs 50*a*, 50*b*, e.g. between the block 10 and the block C. As such, the peg 32 of the block 10 at the end of the arc 50*a* will not insert within the hole 38 of the block C of arc 50*b*. In some embodiments, actual blocks 10, A, B, C have sufficient elasticity that notwithstanding the interference and gaps shown in FIGS. 8A and 8B, forming of loops is still possible through the application of force.

In some embodiments, the two arcs 50*a*, 50*b* shown in FIGS. 7A, 7B, 8A, and 8B are not used to finish a row. Instead a row can be built in a circular fashion and connected using less than all of the blocks A, B, and C, such as just blocks A and B. For example, the block 10 at the right end of the arc 50*a* may joint to another block 10 at the right end of the arc 50*b*, rather than to a block C. In still other embodiments, a row may be completely formed of blocks 10 having arms 26 and pegs 32 mated to slots 34 and apertures 38 of adjacent blocks to form a complete loop.

Figure 9B:
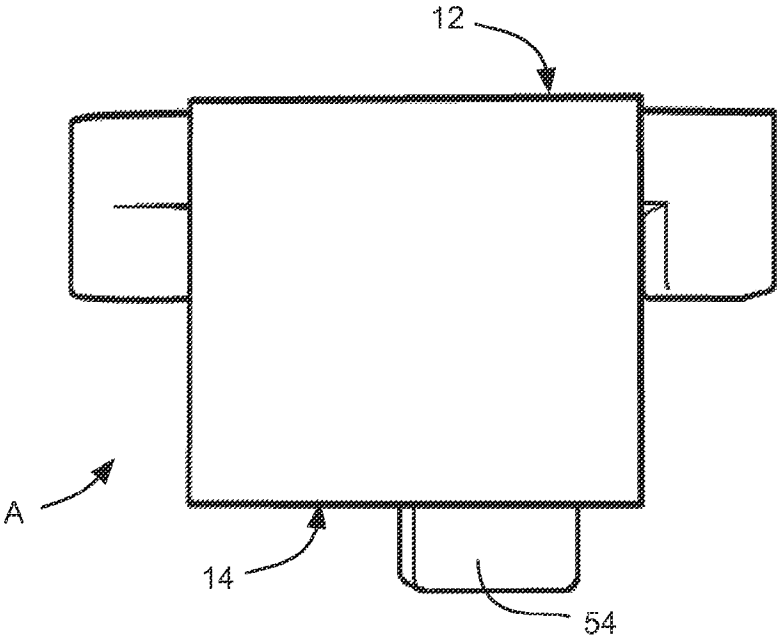
FIG. 9B is a front view of the block of FIG. 5B.
Figure 9A:
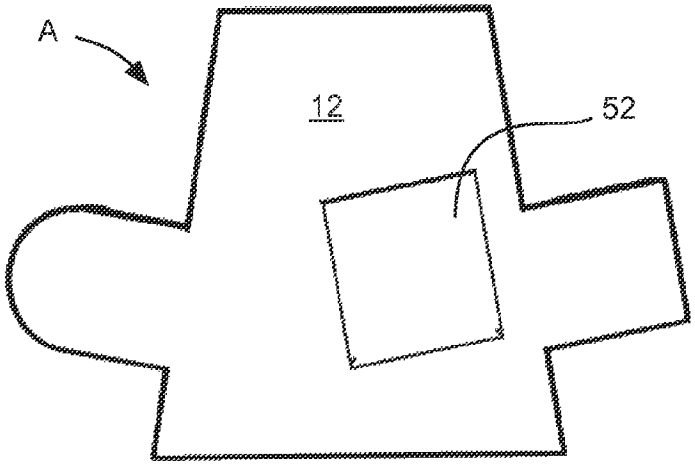
FIG. 9A is a top view of the block of FIG. 5A.

Referring to FIGS. 9A and 9B, some blocks of the building system may have features used to join rows together, i.e. the rows formed of loops of blocks shown in FIG. 7B. In the illustrated embodiment, the block A includes an aperture 52 passing inwardly into the top surface 12 of the block A and a peg 54 sized and positioned to insert within the aperture 52 of another block A protruding from the bottom surface 14 of the block A.

Other configurations are possible, such as the peg 54 emanating from the top surface 12 and the aperture 52 passing inwardly from the bottom surface 14. Likewise, the aperture 52 and peg 54 may be included in a different type of block 10, B, C.

Figure 10B:
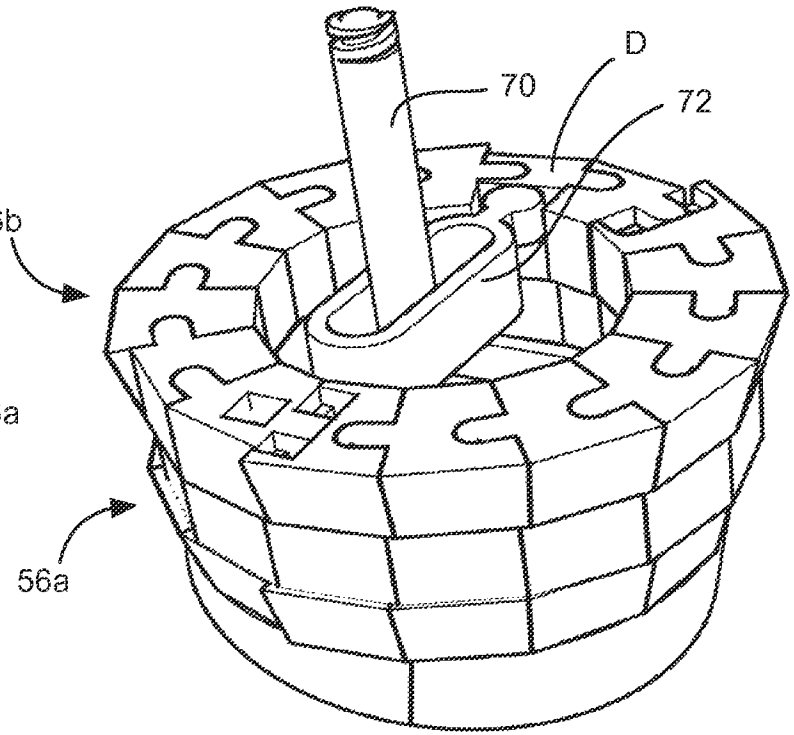
FIGS. 10A and 10B illustrate the alignment of adjacent rows.
Figure 10A:
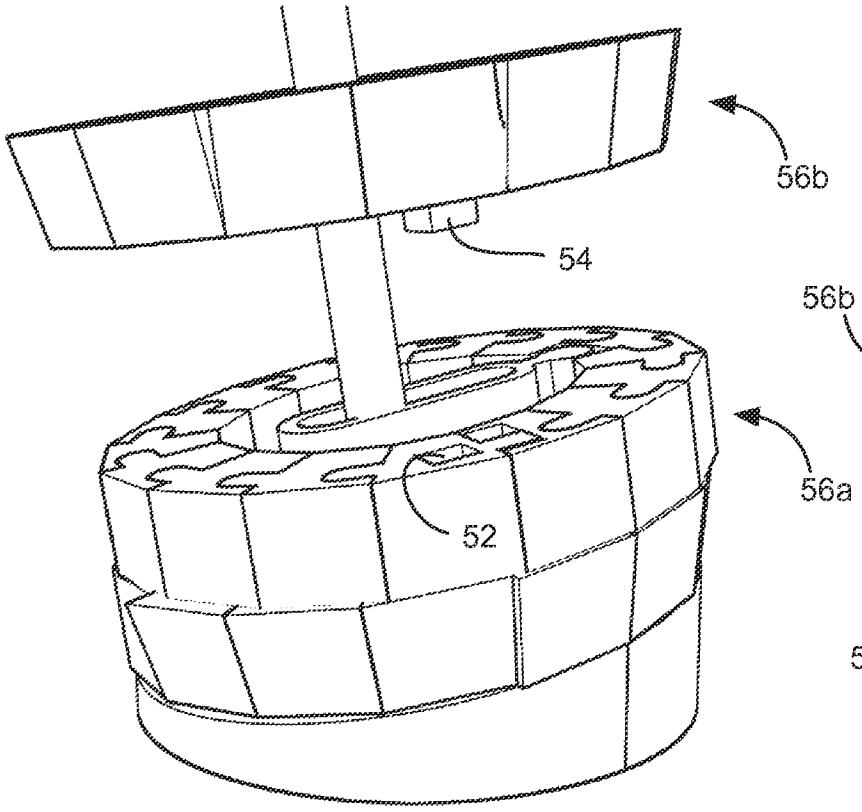

Referring to FIGS. 10A and 10B, in use rows 56*a*, 56*b* of blocks are assembled. The rows may be closed loops or may be open ended chains of blocks. The size of the row may depend on the number of blocks and the angles 20 of the blocks included in the row 56*a*, 56*b*. Each row 56*a*, 56*b* may be a loop of blocks, such as discussed above with respect to FIGS. 7A, 7B, 8A, and 8B. One loop may be joined to another by inserting the peg 54 of a block A in row 56*a* into the aperture 52 of a block A in row 56*b*. The aperture 52 and peg 54 may be sized such that deformation of the block A defining the aperture 52 and/or the peg 54 is required to insert the peg 54 into the aperture 52 thereby retaining the peg 54. Other coupling systems may be used rather than aperture 52 and peg 54 and the aperture 52 and peg 54 may have complimentary grooves and ridges or other features that facilitate engagement.

In the illustrated embodiment, there is one block in each row 56*a*, 56*b* that has an aperture 52 and peg 54. As the user builds rows 56*a*, 56*b*, they place one row 56*b* on top of the preceding row 56*a* below. The user inserts the peg 54 from the row 56*b* into the aperture 52 on the row 56*a* below. Other variations to position the top row on the bottom row can be used, such as if the peg 54 and aperture 52 placement on the upper and lower row are reversed to achieve the same effect. In this version there would be an aperture 52 on the bottom of a block on top row 56*b* and a peg 54 protruding up on the bottom row 56*a*.

The function of the aperture 52 and peg 54 is to align every row in the proper direction and position. There is mostly only one block 10, A, B, C on every row 56*b*, which will align correctly with another block 10, A, B, C on the row 56*a* below. As noted above, the apertures 52 and peg 54 further creates an attachment between rows 56*a*, 56*b*. However, the primary means of securing rows 56*a*, 56*b* is performed using the core rods discussed below with respect to FIGS. 13 through 24.

Figure 11B:
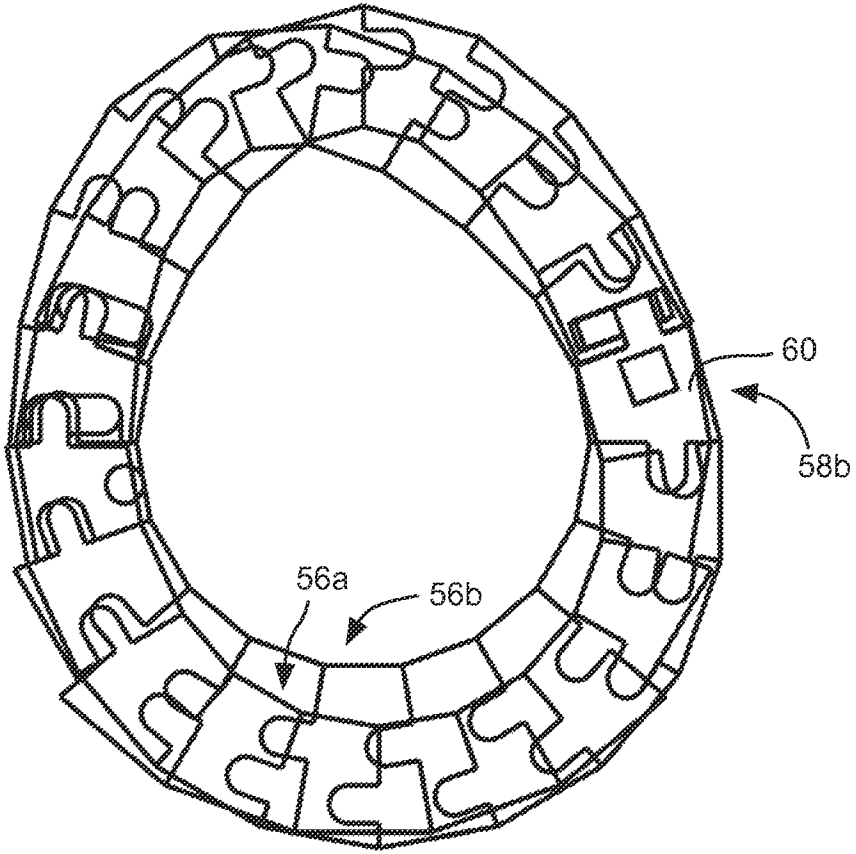
FIGS. 11A and 11B illustrate proper and improper alignment of rows using the block type of FIG. 5A in accordance with an embodiment of the present invention.
Figure 11A:
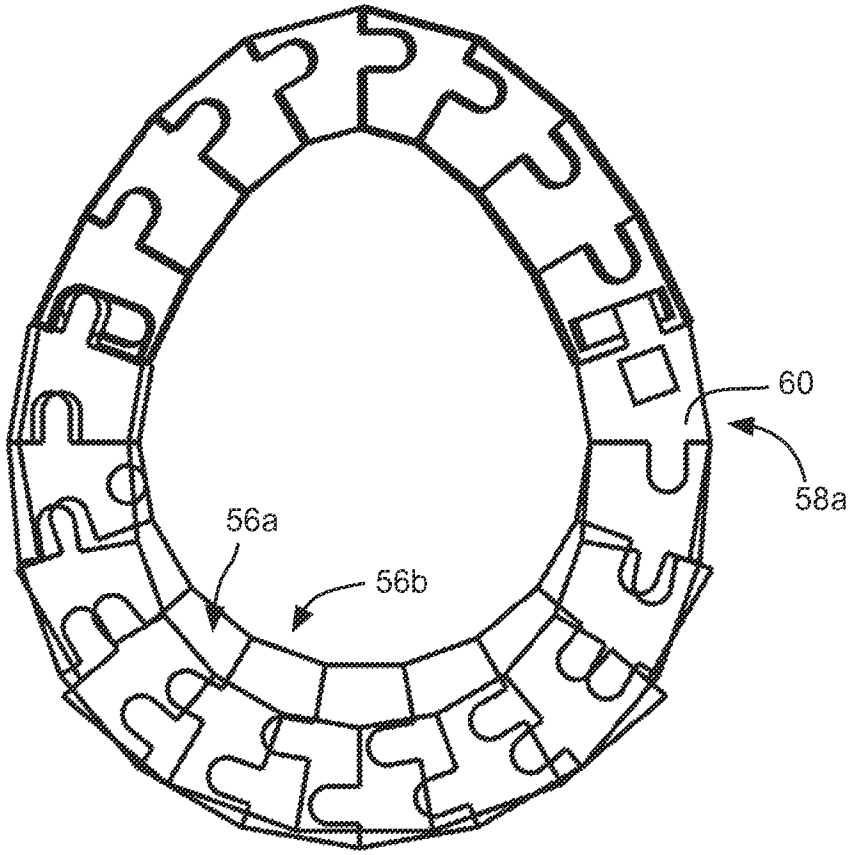

FIGS. 11A and 11B, show a row 56*b* (dashed) on top of a row 56*a* (solid) aligned in two positions: 58*a* and 58*b*. The rows 56*a*, 56*b* in FIGS. 11A and 11B are the same exact rows, e.g. the same blocks 10, A, B, C in the same configuration. The only aspect that is changed between FIGS. 11A and 11B is how the top row 56*b* is aligned on the row 56*a* below. In FIG. 11A, the rows are aligned in position 58*a*, using block 60 (e.g. a block A). This is a correct alignment and the blocks of the rows 56*a*, 56*b* mesh and blend together. In FIG. 11B, the rows 56*a*, 56*b* are aligned in position 58*b*, using block 60. The alignment of the top row 56*b* is incorrect. The top row 56*a* does not mesh with the bottom row 56*b*. In particular, as is apparent in FIG. 12B, the top row 56*a* is off center and does not blend with the bottom row 56*b*. Alternatively, if a ragged look is desired, or any other appearance, correct alignment may still be preferred, which is accomplished through the same top hole and bottom peg alignment system.

In some embodiments, the aperture 52 and peg 54 are part of the same block, e.g. a block A. However, the aperture 52 and peg 54 do not have to be located on the same block. In some instances, due to the position of how two rows 56*a*, 56*b* are placed on top of each other (see discussion regarding FIGS. 11A and 11B, above), the peg 54 has to be placed on a different block. For example, the building system may include one or more blocks C having a peg 54 protruding from the bottom surface 14 thereof to create an "H" block. In some embodiments, one or more "G" blocks may be included in the building system, which is the same as a block A having the peg 54 omitted, e.g. a flat bottom surface 14. In a like manner, other types of blocks may be modified to include a peg 54. For example, the building system may include one or more blocks B including a peg 54 protruding from the bottom surface 14 thereof to create an "I" block. The building system may include one or more basic blocks 10 having a peg 54 protruding from the bottom surface 14 thereof to create an "F" block.

Referring again to FIG. 10B, the rows 56*a*, 56*b* of a figure may be secured to one another by a core rod system. As shown, this may include a core rod 70 that extends through the loops of blocks forming the rows 56*a*, 56*b*. Each row 56*a*, 56*b*, a portion of the rows 56*a*, 56*b*, may be coupled to the core rod 70 by core links 72 that engage both the core rod 70 and one of the blocks of the row 56*a*, 56*b*. In particular, the core link 72 may engage a block D that is included in the row 56*a*, 56*b*.

Figure 12:
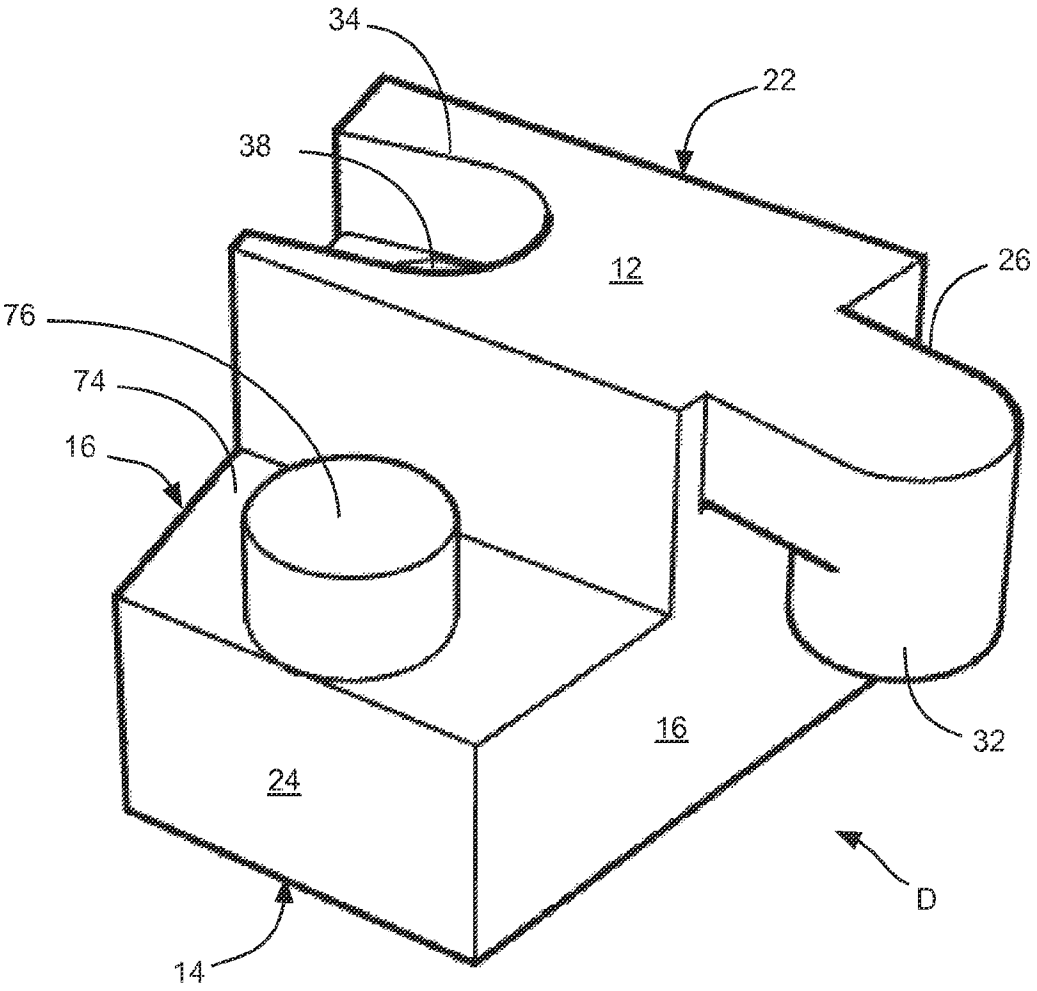
FIG. 12 illustrates a block for coupling to a core link in accordance with an embodiment of the present invention.

Referring to FIG. 12, the block D may include a recessed surface 74 that extends from the inner surface 24 toward the outer surface 22, but not completely. The recessed surface 74 is offset from the top surface 12 and may be parallel to the top surface 12. A peg 76 protrudes upwardly from the recessed surface 74 toward the top surface 12. In the illustrated embodiment, the peg 76 protrudes toward the top surface 12 from the recessed surface 74 a distance less than or equal to the distance between the top surface 12 and the recessed surface 74 measured perpendicular to the recessed surface. The block D may be identical to a basic block 10 but for the recessed surface 74 and peg 76.

Figures 13A, 13B, 13C:
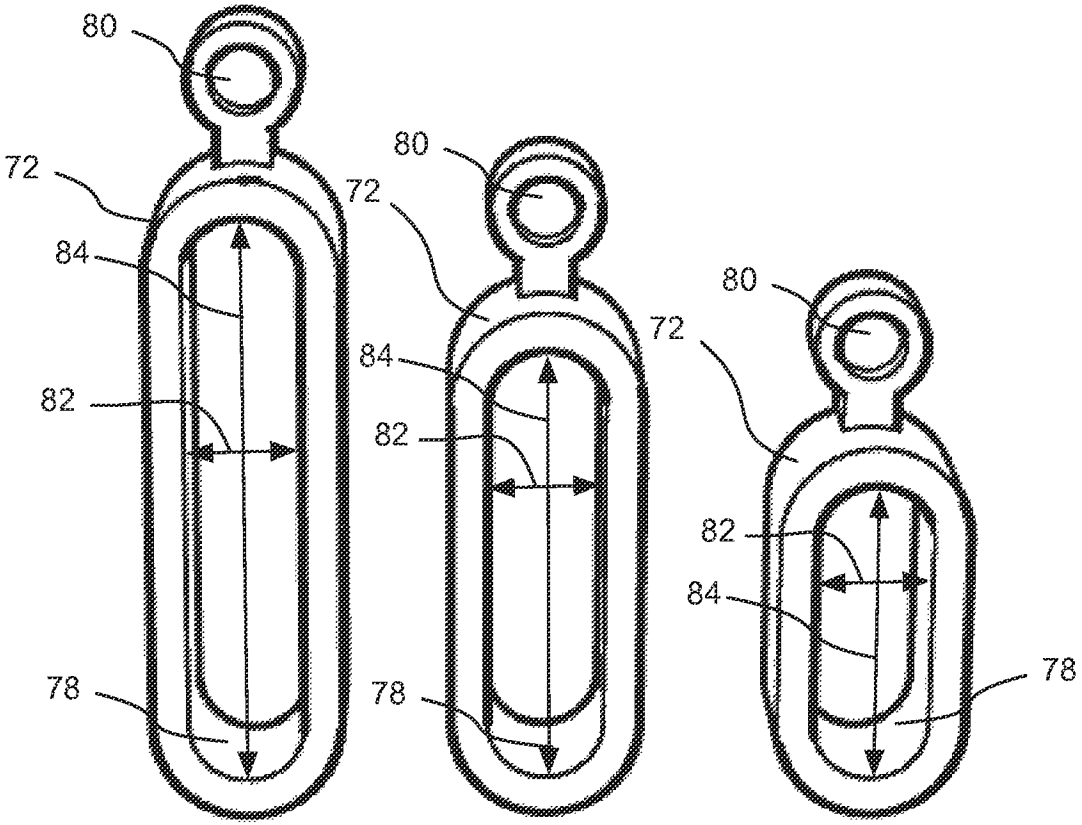
FIGS. 13A to 13C illustrate core links for coupling to a core rod in accordance with an embodiment of the present invention.

Referring to FIG. 13A to 13C, the core links 72 may include a core aperture 78 sized to receive the core rod 70 and a peg aperture 80 sized to receive the peg 76 of the block D. As is apparent in FIG. 13, the core aperture 78 may be elongate such that a core rod 70 inserted therein may be located at various positions. For example, the core aperture 78 may have a width 82 equal to that of the core rod 70, e.g. sized to receive the core rod 70 a snug fit that permits unhindered insertion of the core rod without room for movement parallel to the width 82 or a snug fit that permits unhindered insertion of the core rod. The core aperture 78 may have a length 84 that is longer than the width of the core rod 70 such that the core rod 70 may be positioned at various positions along the length 84 of the core aperture 78. As shown, the length 84 may be measured on a line intersecting the center of the peg aperture 80 and the width 82 may be measured perpendicular to that line. In some embodiments, spacers may be placed over a core rod that are identical to the core links 72 but lack a peg aperture 80 for securement to a block D.

Figure 14A:
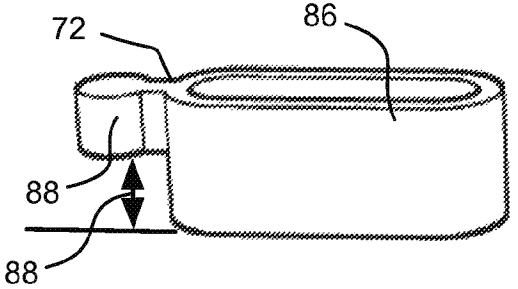
FIGS. 14A to 14C illustrate core links having various configurations in accordance with an embodiment of the present invention.
Figure 14B:
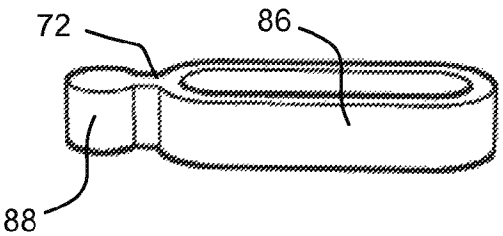
Figure 14C:
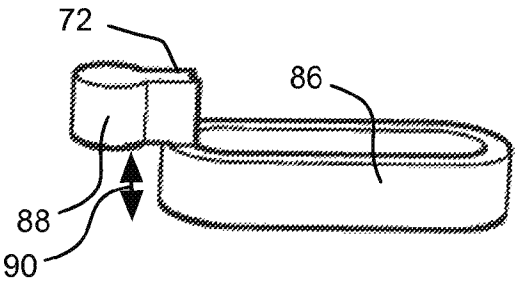

Referring to FIGS. 14A through 14C, the core aperture 78 may be formed in a core aperture portion 86 of the core link 72 and the peg aperture 80 may be formed in a peg aperture portion 88 of the core link 72. The building system may include core links having core aperture portion 86 and peg aperture portion 88 with various configurations.

For example, as shown in FIG. 14A, the core aperture portions 86 may have a height equal to the distance between the top and bottom surfaces 12, 14 of the blocks 10, A, B, C, D. The peg aperture portion 88 may include an offset surface 90 that is offset from the lower surface of the core aperture portion 86. The offset of the offset surface 90 may be equal to the offset from the bottom surface 14 of the block D to the recessed surface 74.

As shown in FIG. 14B, the portions 86, 88 may have similar heights that are less than the distance between the top and bottom surfaces 12, 14 of the blocks 10, A, B, C, D, e.g. half. As shown in FIG. 14B, the portions 86, 88 may have similar heights having the peg aperture portion 88 offset above the core aperture portion 86, the offset being equal to the offset from the bottom surface 14 of the block D to the recessed surface 74.

Figure 15:
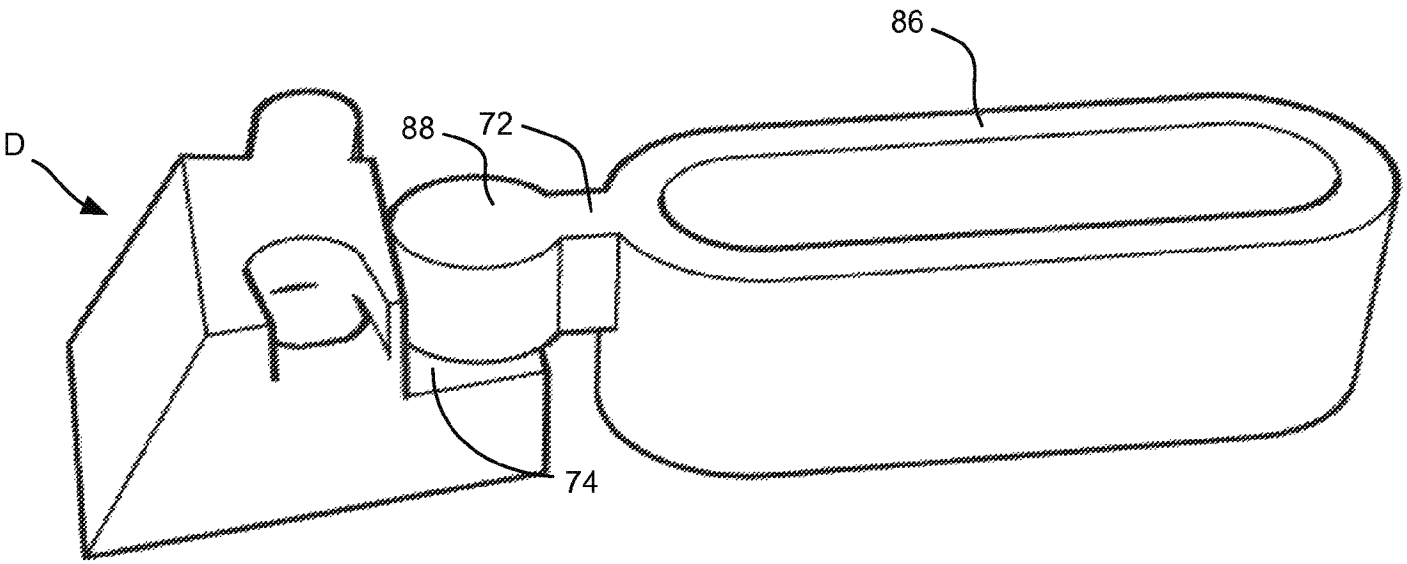
FIG. 15 illustrates a core link coupled to the block of FIG. 12 in accordance with an embodiment of the present invention.

Referring to FIG. 15, in use, the peg aperture 80 is placed over the peg 76 of the block D and the core rod 70 is inserted through the core aperture 78, as shown in FIG. 10B. In this manner, all of the rows 56*a*, 56*b* including a block D and a core link 72 fastened thereto may be joined together due to engagement with a common core rod 70.

Figure 16:
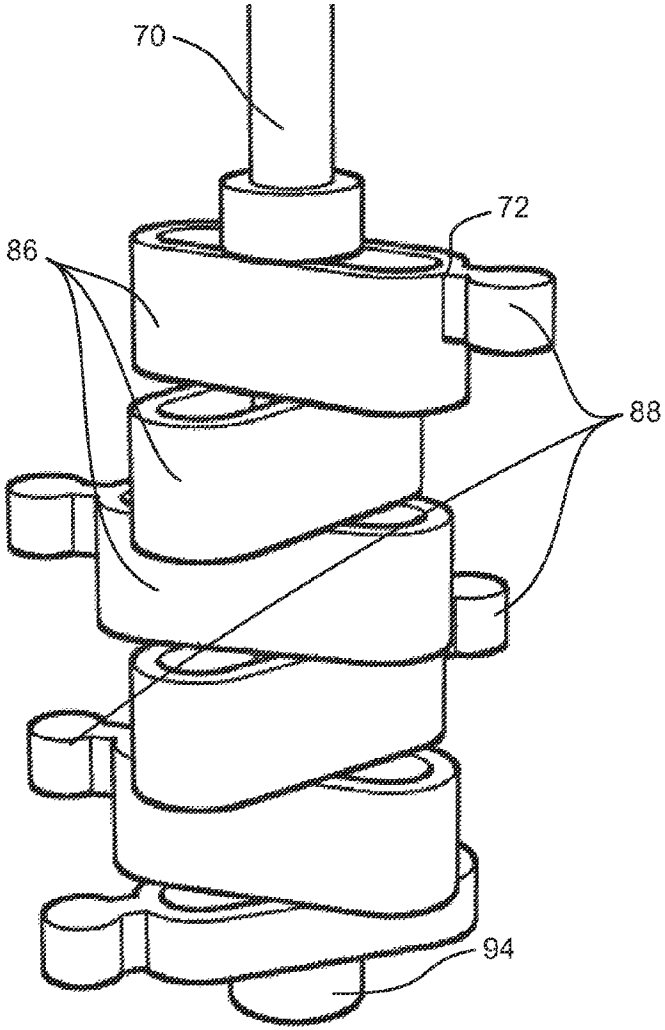
FIG. 16 illustrates a plurality of core links coupled to a core rod in accordance with an embodiment of the present invention.

For example, FIG. 16 shows a core rod 70 having a plurality of core links 72 secured therewith. By securing the peg apertures 80 of the core links 72 to the blocks D of various rows 56*a*, 56*b* the rows 56*a*, 56*b* may be maintained in alignment and in a stacked configuration. When many rows are stacked on top of each other, the core links 72 in the center of the figure are also being stacked on top of each other as shown in FIG. 16. The core links 72 will always have contact with each other since the core rod 70 is always being inserted through the core connectors. Contact between core connectors may play an important role when the rows become locked in place.

Figure 17:
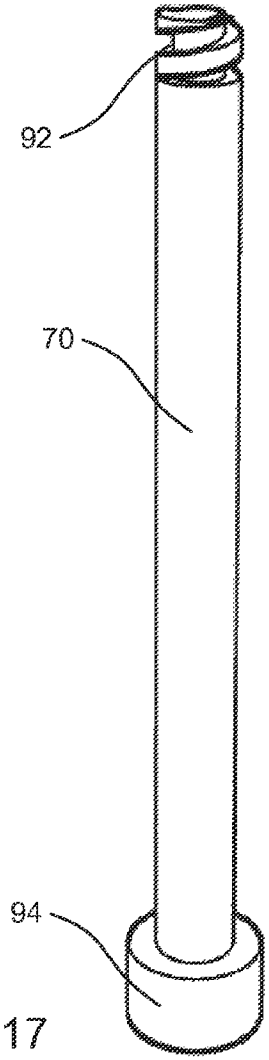
FIG. 17 illustrates an example configuration of a core rod in accordance with an embodiment of the present invention.

Referring to FIG. 17, a core rod 70 may itself secure to other core rods or other parts of the building system. For example, the core rod 70 may include a threaded end portion 92 at a first end and a threaded aperture 94 at a second end opposite the first end. The illustrated core rod 70 has a round cross section along the longitudinal axis thereof between the first and second ends. However, square, hexagonal, oval, or other cross-sectional shapes may also be used. A building system may include core rods 70 of various lengths for use forming various figures and parts of figures.

Figure 18B:
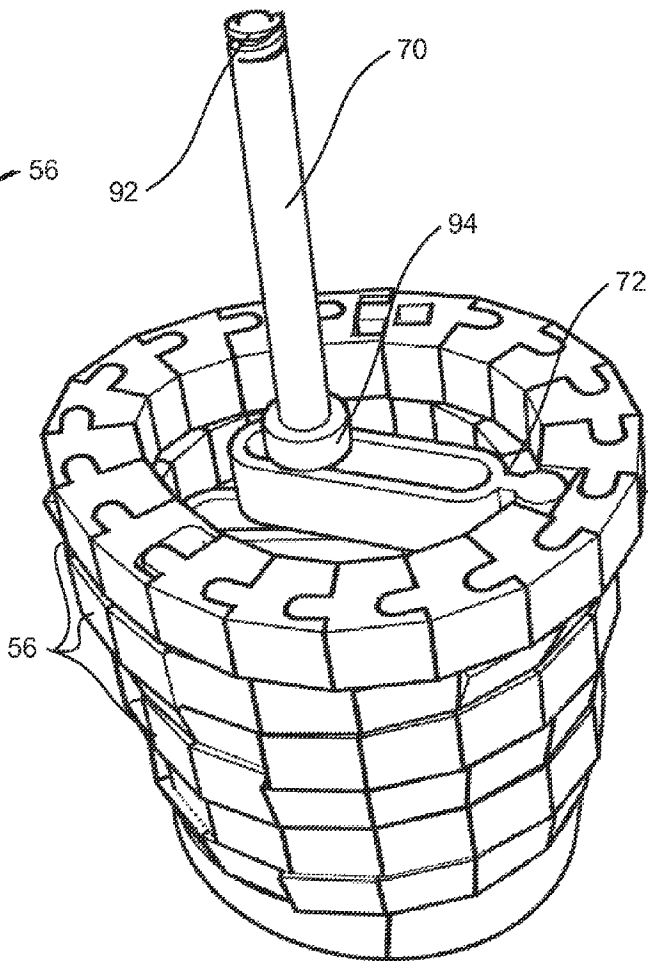
FIGS. 18A and 18B illustrate the fastening of core rods to one another in accordance with an embodiment of the present invention.
Figure 18A:
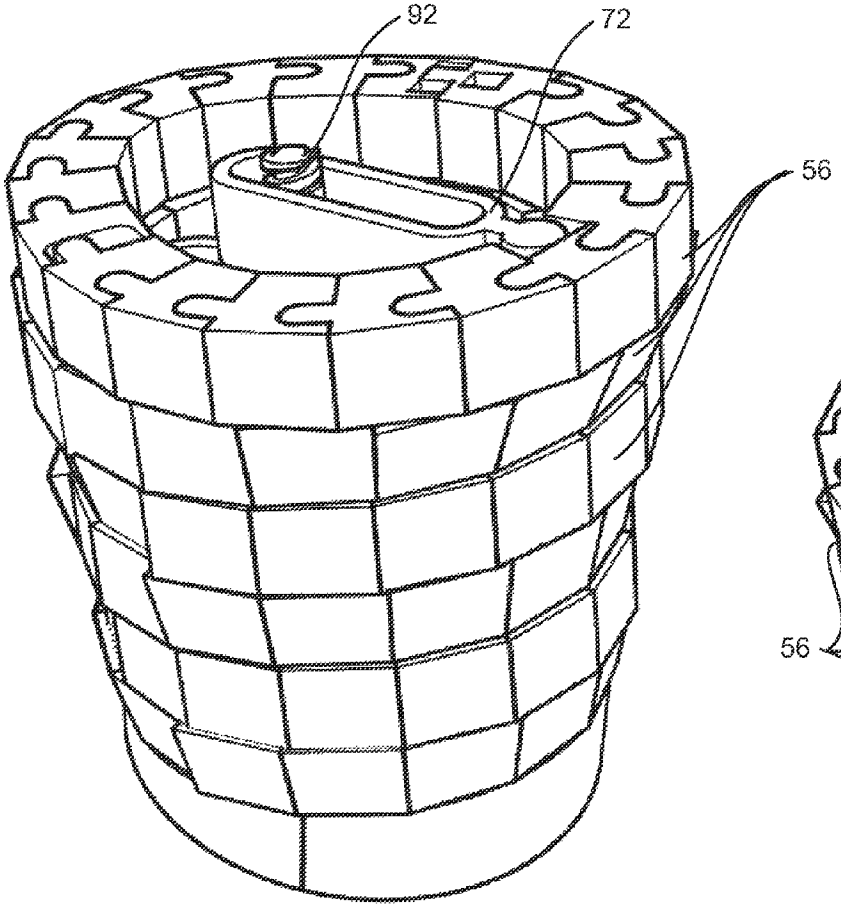

For example, as shown in FIGS. 18A and 18B, a core rod 70*a* may be inserted through various rows 56 of blocks. A second core rod 70*b* may then be secured to that core rod 70*a* as shown in FIG. 18B, such as by engaging the threaded aperture 94 of the core rod 70*b* with the threaded end portion 92 of the first core rod 70*a*, or vice versa. Additional rows 56 of blocks may then be secured to the core rod 70*b* according to the approaches described herein.

Rows 56 of blocks may be locked into place when the second core rod 70*b* is screwed onto the preceding core rod 70*a*. The rows 56 located on the preceding core rod 70*a* are the rows being locked into place. After the core rods 70*a*, 70*b* are connected, the bottom of the second core rod 70*b* presses down firmly on the core links 72 encircling the core rod 70*a*. When the bottom core rod 70*a* is thus "capped" and "sealed" by the top core rod 70*b* screwing down, the movement of the core links 72 is restricted and they cannot move up or down. Since the core links 72 are each attached to a row 56, the movement of the rows 56 are therefore also restricted.

Figure 20A:
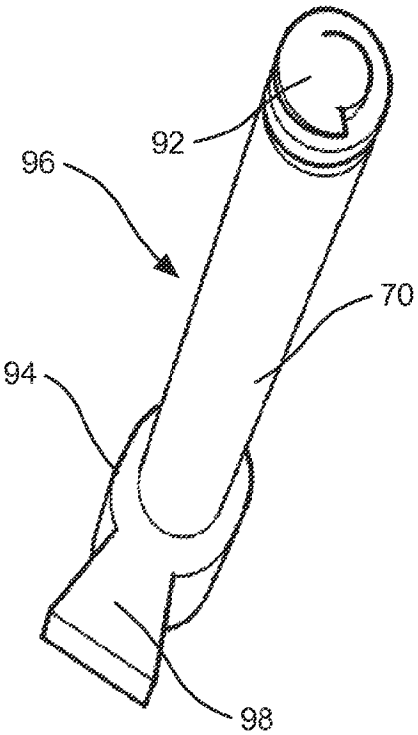
FIGS. 20A and 20B illustrate the use of the starter core rod of FIG. 19 in accordance with an embodiment of the present invention.
Figure 20A:
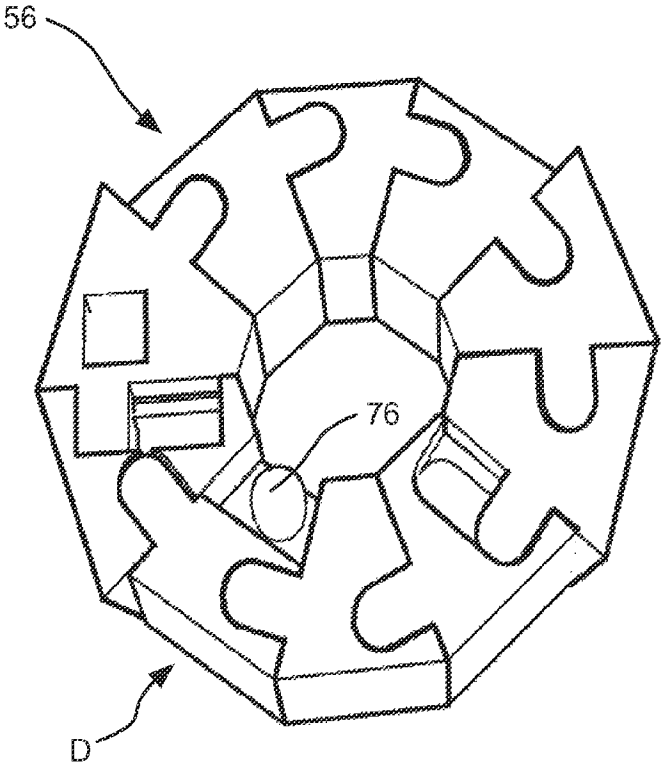
Figure 19:
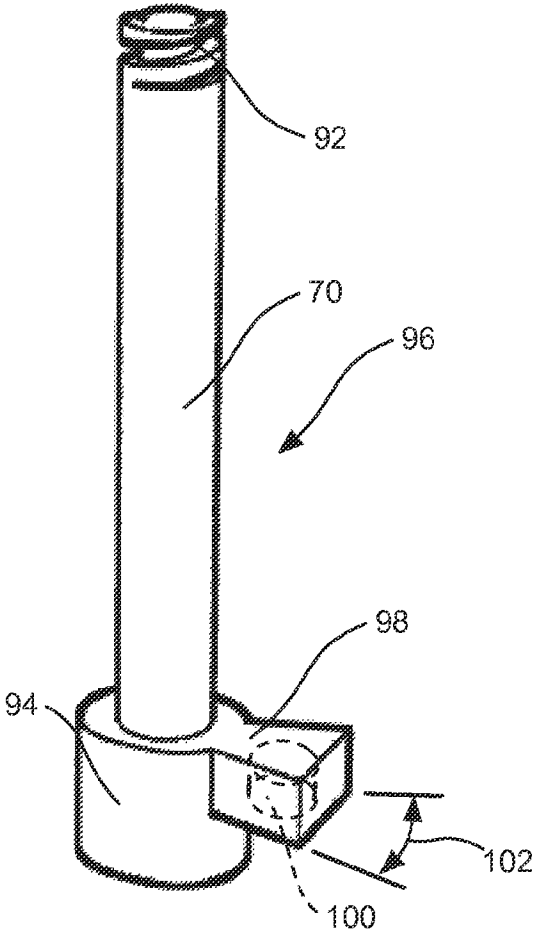
FIG. 19 illustrates a starter core rod in accordance with an embodiment of the present invention.
Figure 20B:
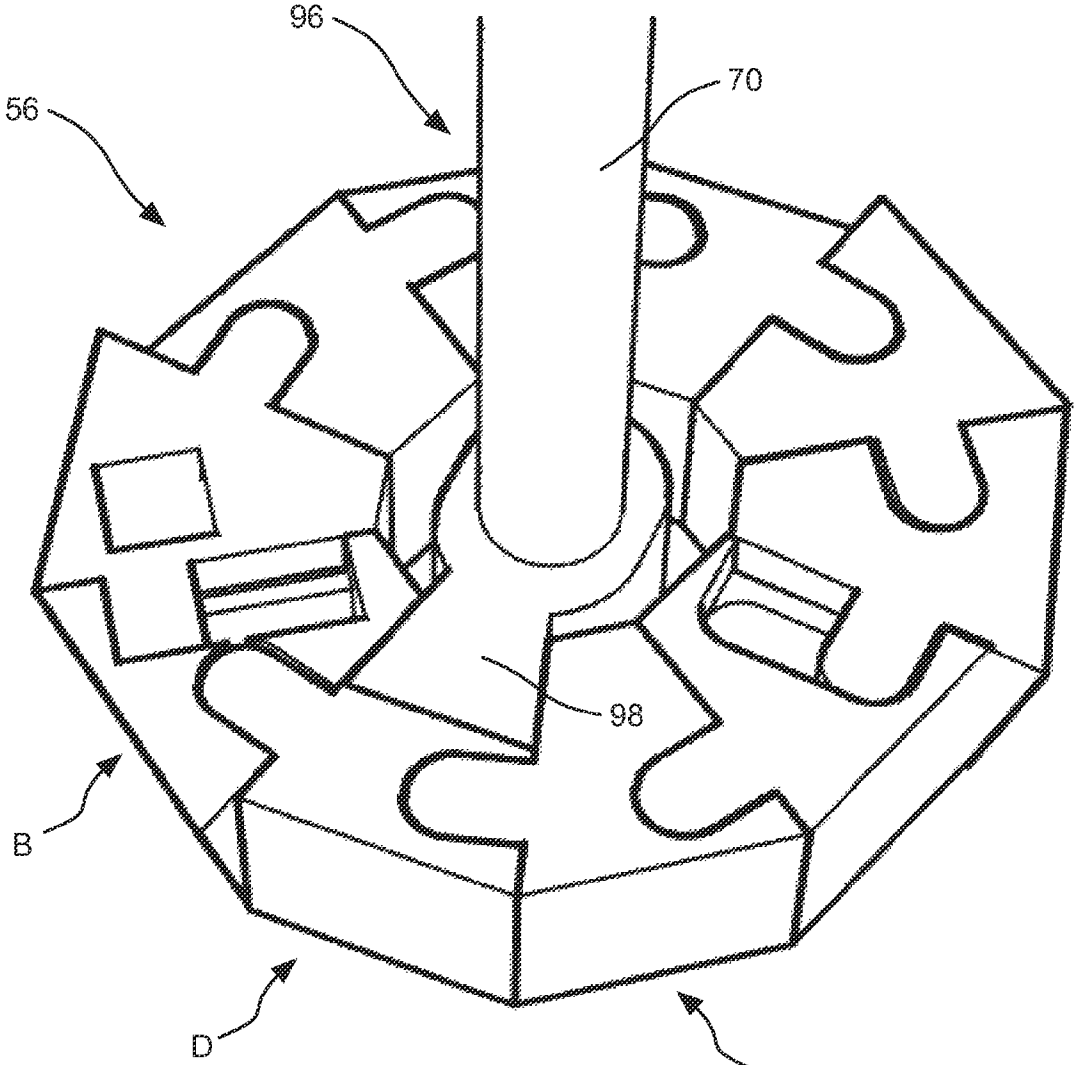

Referring to FIGS. 19 and 20A and 20B, a core rod 70 may be part of a starter core rod 96 used to secure to an initial row 56 of a stack of rows. The starter core rod 96 may include a flange 98 extending outwardly from the longitudinal axis of the rod 70 and defining an aperture 100 sized to receive the peg 76 of a block D such that a retaining force is required to insert the peg 76 into the aperture 100 and remove the peg 76 from the aperture 100. As is apparent in FIG. 20B, the aperture 100 may be placed over the peg 76 of a block D thereby securing the starter core rod 96 to the block D and the row 56 including the block D.

As is apparent in FIGS. 20A and 20B, the flange 98 may define a flare angle 102 such that that the flange does not extend outwardly from the recess surface 74 of the D block, thereby ensuring that the flange 98 will not interfere with any blocks 10, A, B, C secured on either side of the block D.

The rod 70 of the starter core cord 96 may include a threaded end portion 92 and threaded aperture 94. In the illustrated embodiment, the threaded aperture 94 protrudes beyond the flange 98 and the threaded end portion 92 is positioned at an opposite end from the flange 98, however the locations of the threaded end portion 92 and threaded aperture 94 may be reversed in some embodiments. Using the threaded end portion 92 and threaded aperture 94, additional core rods 70 may be secured to the starter core rod 96 as described above in order to clamp rows onto the starter core rod 96.

Figure 21A:
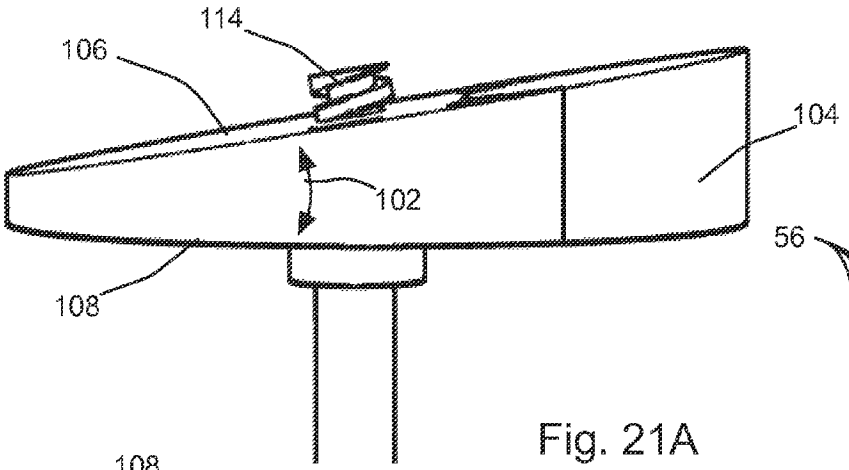
FIGS. 21A and 21B illustrate a slant block in accordance with an embodiment of the present invention.
Figure 21B:
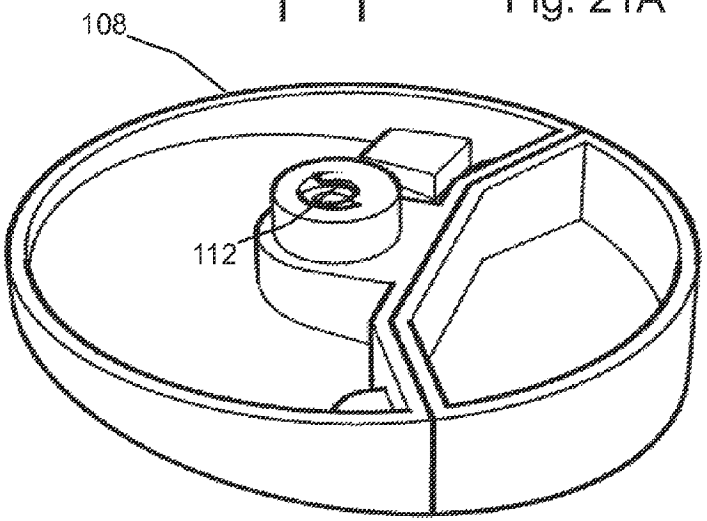

Referring to FIGS. 21A and 21B, the building system may further include slant blocks 104 defining an upper surface 106 and a lower surface 108 opposite the upper surface, the upper surface 106 defining a slant angle 110, e.g. 15 degrees, 30 degrees, or some other angle, relative to the lower surface 108. The extent of the surfaces 106, 108 may correspond to the perimeter of a row 56 of blocks placed adjacent the surfaces 106, 108 such that the perimeter of the slant block 104 and the rows on either side blend with one another.

One of the surfaces 106, 108 may include a threaded aperture 112 whereas the opposite surface 106, 108 defines a threaded post. In this manner, a core rod 70 may secure to both of the surfaces 106, 108. Due to the slant angle 110, core rods 70 secured to the surfaces 106, 108 will have a corresponding angle 110, thereby enabling a stack of rows to define a wider variety of shapes.

Figure 22:
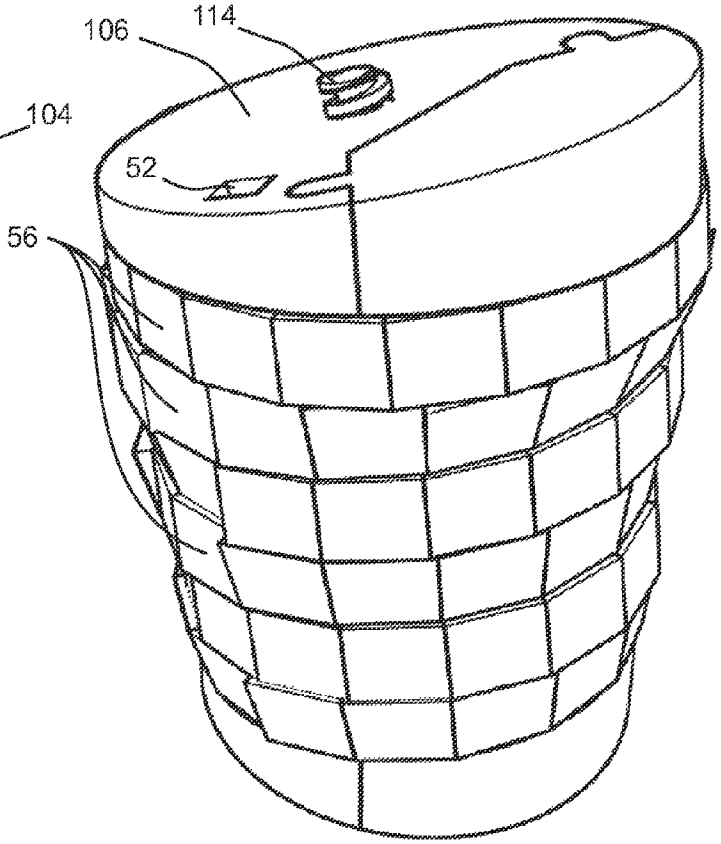
FIG. 22 illustrates use of the slant block of FIGS. 21A and 21B in accordance with an embodiment of the present invention.

As shown in FIG. 22, a slant block 104 may be secured to a plurality of rows 56 of blocks secured with a core rod 70 as described above. Another core rod 70 may then be secured to the threaded post 114 of the slant block and further rows 56 may then be added to the core rod 70 as described above.

The threaded engagement of the slant block 104 with upper and lower core rods 70 enables the slant block to seal or cap the rows 56 coupled to that core rod as described above using core links 72. As such, two core rods 70*a*, 70*b* do not necessarily have to join on top of each other as described above with respect to FIGS. 18A and 18B.

When rows are normally stacked on top of each other, the resulting figure "grows" straight and vertical. Normal rows are stacked on the straight geometrical "Y" axis. In order to deviate from building straight, a slant block 104 is inserted to create a bend. The angle 110 of the slant block 104 will dictate how big of a slant or bend will result. For example, a 15 degree slant will result in a smaller bend and a 30 degree slant will result in a larger slant in the resulting figure. In some embodiments, the upper surface 106 may include an aperture 52 sized to receive a peg 54 of a block A or other type of block including a peg 54 in order to align a row secured to the upper surface 106. In some embodiments, the lower surface 108 may include a peg 54.

FIG. 23 illustrates an example of a FIG. 120 that may be created using the building system described herein. Rows 122 of blocks assembled and secured to one another as described herein may form the tail, torso, and neck of the figure. Likewise, rows 124 of blocks assembled and secured to one another as described herein may form the legs of the figure.

Other special blocks may form details of the figure. For example, a block 10, A, B, C, D of a row 122 may include arms 126 secured thereto. A tail piece 128 may threadably secure to a core rod, or series of core rods, securing the rows 122 of the tails, torso, and neck together as described herein. Likewise, foot pieces 130 may threadably secure to core rods securing the rows 124 of the legs of the figure together as described herein.

A head of the figure may be formed of rows 132. Blocks 10, A, B, C, D of the rows 132 may include features such as eyes 134 and teeth 136 secured thereto. In some embodiments, an L-shaped core rod secures to the core rod securing the rows 122 of the torso to one another. The rows 132 secure to this L-shaped core rod, thereby enabling the change in angle of the axis along which the rows 132 of the head are stacked relative to the direction along which the rows 122 of the torso and neck are stacked. Core rods with other contours or bends of various angles may be used to form various types of figures.

The lower jaw of the figure may include rows 138 of blocks that pivot relative to the rows 132 of the head. A tongue piece 140 may be one of the blocks of the rows 138, secure to one or more blocks of the rows 138, or secure to the back of core rod 150. For example, referring to FIG. 24, a block 142 may define an aperture 144 sized to receive a core rod coupling the rows 122 of the torso to one another. The block 142 may define a socket 146 sized to receive a ball 148 formed at one end of a core rod 150. The block 142 may be secured to a core rod of the torso 122 and the ball 148 of the core rod 150 secured within the socket 146. Blocks as described herein may be secured to the core rod 150 to form the rows 138 of blocks of the lower jaw. In particular, teeth 136 and the tongue 140 (see FIG. 23) may secure to blocks secured to the core rod 150 by means of pegs inserted into holes in the blocks of the rows 138 of the lower jaw.

Figure 25A:
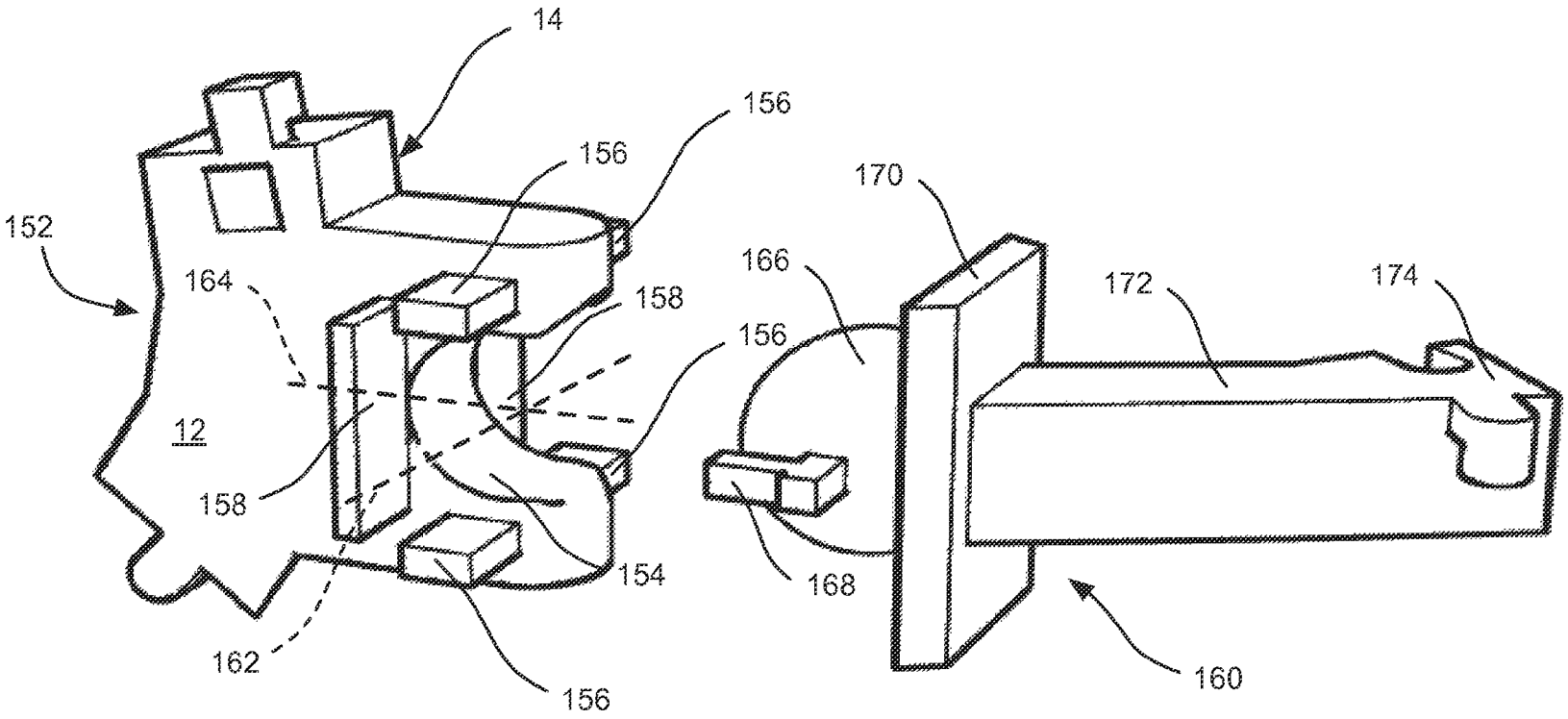
FIGS. 25A and 25B illustrate blocks for forming the pelvis of the figure of FIG. 23.
Figure 25B:
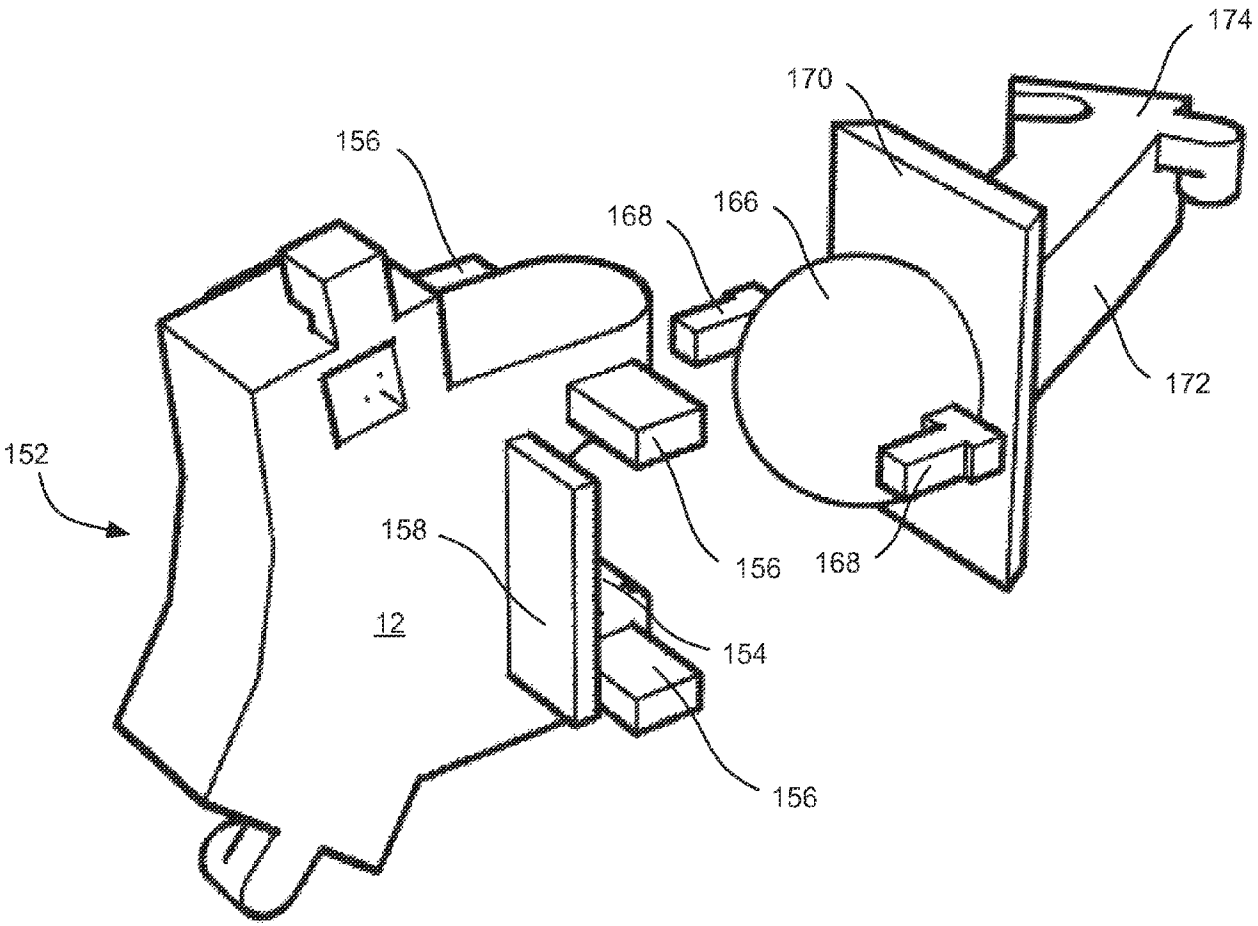

Referring to FIGS. 25A and 25B, the rows 124 of the legs may secure to the rows 122 of the torso using the illustrated blocks. Specifically, a row 122 of the torso may include the illustrated block 152 that may include some or all of the attributes of any of the types of blocks described herein except for a socket 152 protruding from the outer surface thereof. For example, the illustrated block 152 has the attributes of an A block as described above in addition to the attributes specific to the block 152. The block 152 may have the attributes of a block 10, B, C, D, or some other type of block in other embodiments. The block 152 may defined stops 156 and stops 158 to limit motion of a corresponding block 160 secured within the socket 154. Specifically, top and bottom stops 156 limit rotation of the block 158 about an axis 162 and lateral stops 158 limit rotation of the block 160 about an axis 164 that is perpendicular to the axis 162. In the illustrated embodiment, the axis 164 is perpendicular to the top and bottom surfaces 12, 14 of the block 152 whereas the axis 162 is parallel to the top and bottom surfaces 12, 14 and perpendicular to the axis 164.

The block 160 defines a ball 166 sized to insert within the socket 154 such that force is required to insert and remove the ball 166. Stop arms 168 may be included protruding from the surface of the ball 166 or secured elsewhere on the block 160. The stop arms 168 may be positioned to engage the stops 156, 158 at certain positions of the block 160 relative to the block 152 in order to impose the limits on rotation about the axes 162, 164.

The block 160 further define a plate 170 and an arm 172 protruding from the plate 170, such that the plate 170 is positioned between the ball 166 and the arm 172. The plate 170 may be operable to limit movement of the arm 172 when the block 160 is in place within a figure. The arm 172 includes a block portion 174 at a distal end thereof. The block portion 172 defines the features of one of the blocks 10, or another type of block described herein such that the block portion 174 may take the place of one of these blocks in the rows 124 of the legs. In the illustrated embodiment, the block portion 174 has the attributes of a basic block 10.

Figure 26:
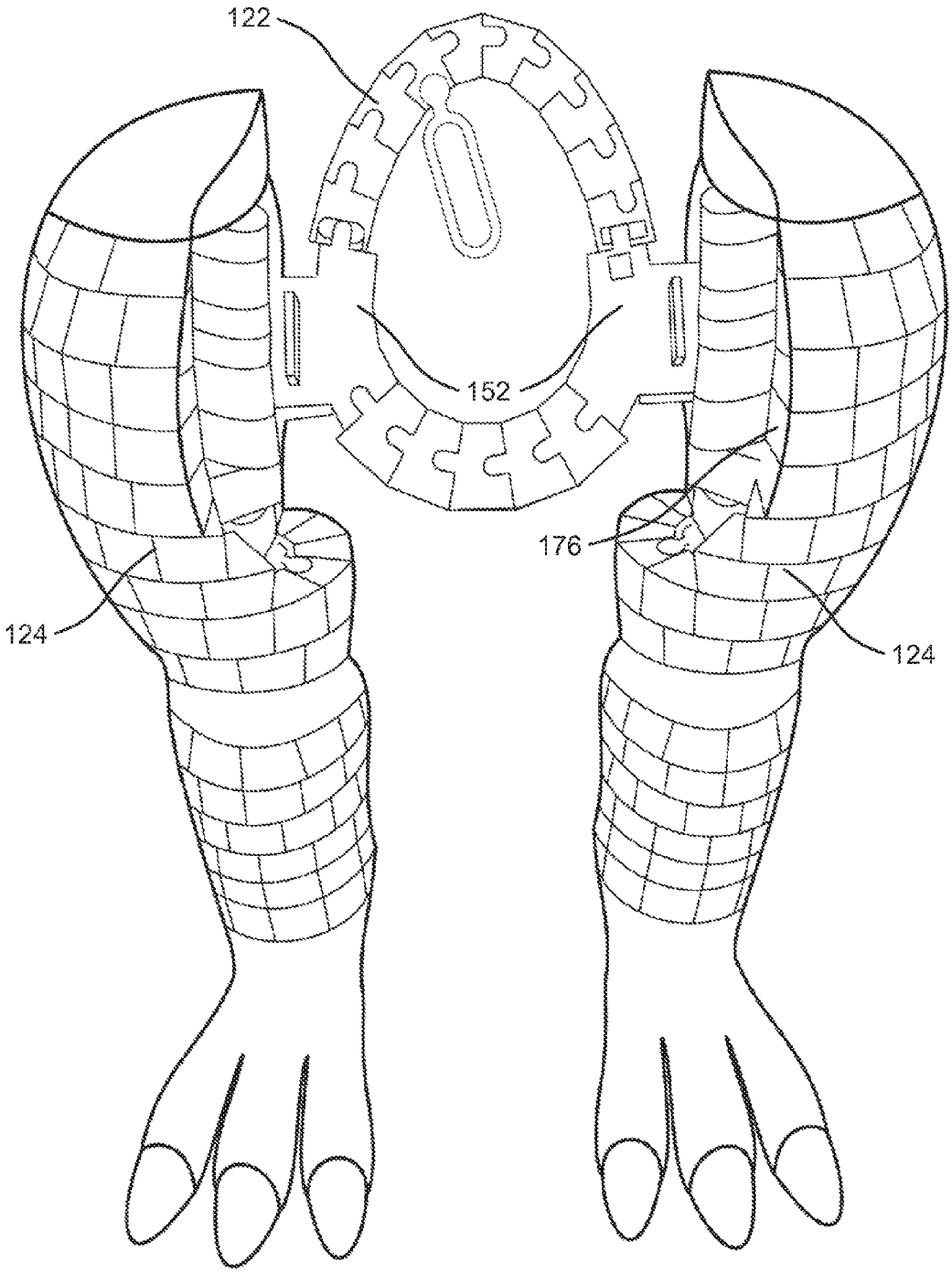
FIG. 26 illustrates a pelvis of the figure of 23.

Referring to FIG. 26, in use, a row 122 of the body is formed having two of the blocks 152 included therein on opposite sides having the sockets 154 facing outwardly. Blocks 160 are included in the rows 124 of the legs and the balls 166 thereof are inserted into the sockets 154 in order to rotatably secure the leg rows 124 to the torso rows 122.

As is apparent in FIG. 26, some of the leg rows 124 do not form complete loops. In some embodiments incomplete rows may be terminated with blocks 176 having smooth surfaces rather than defining arms 26 and pegs 32 or slots 34 and apertures 38. For example a block 176 may be an "M" block that is a basic block 10 lacking an arm 26 and peg 32.

"E" and "K" blocks, may be used when a partial row is built. An "E" block may be embodied as a block 10 lacking the arm 26 and peg 32 and having an aperture 52 and peg 54 as described for block A. A "K" block may be embodied as a basic block 10 having an aperture 52 and peg 54 as described for the block A. The aperture 52 and peg 54 on "E" and "K" Special Blocks may be in a different location on the block than the aperture 52 and peg 54 on a block A that is used on a complete circular row. The size of the top hole and bottom peg on an "E" or "K" block may also be different than the top aperture and bottom peg on a block A.

In some embodiments, when transitioning from a complete circular row, on a lower row 124, to a partial row on a higher row 124, a basic block 10 of the lower row may include an aperture 52. The size and position of the aperture 52 may be consistent with the aperture 52 on the "E" block to form a "J" block or consistent with the aperture 52 on a "K" block to form an "L" block. The aperture 52 may be added to the "J" and "L" blocks in order for the lower row 124 to be aligned and joined with the "E" or "K" blocks on an upper half row 124. The function of the aperture 52 is consistent with the alignment principles of aperture 52 and peg 54 described above with respect to the block A and its purpose is to align the rows.

Referring again to FIG. 23, the rows 122, 124, 132, 138 of the FIG. 120 may be capped in order to retain the rows 122, 124, 132, 138 in the illustrated configuration. For example, a cap 178 may secure to a core rod at the top of the leg rows 124 in order to capture the leg rows between the foot pieces 130 and the cap 178. A cap 180 may secure to a core rod passing through the rows 122 at the top of the rows 122 in order to capture the neck, torso, and tail rows 122 between the tail piece 128 and the cap 176. A cap 182 may form the nose and secure to the L-shaped core rod to which the head rows 132 are mounted in order to capture the head rows 132 between the cap 182 and the rows 122. A cap 184 may secure to the core rod 150 in order to retain the lower jaw rows 138.

Figure 27:
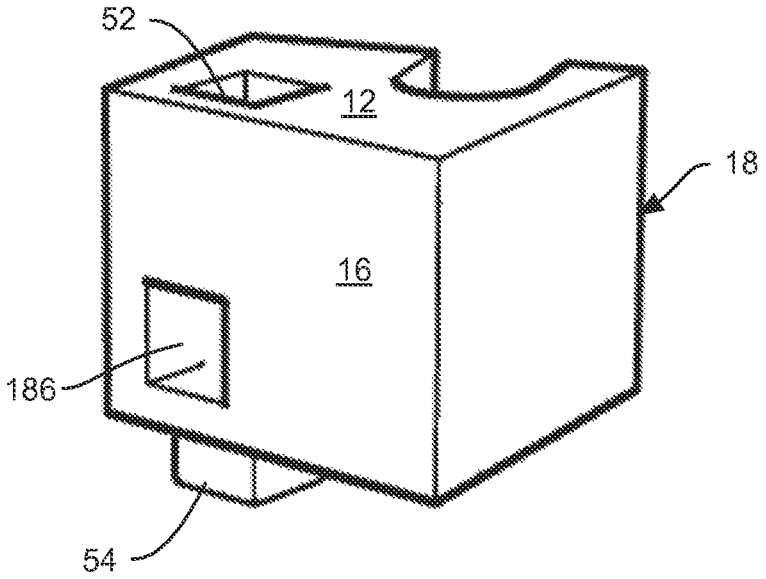
FIG. 27 illustrates blocks for forming part of the head of the figure of FIG. 23.

Referring to FIG. 27, in some embodiments, a FIG. 120 may include two rows joined together in a perpendicular manner, such as the head rows 132 and the rows 122 of the neck, torso, and tail. Accordingly, a block N may be used that includes both an aperture 52 on a top surface 12, peg 54 on the bottom surface 14 thereof and an aperture 186 on one of the side surfaces 16, 18 in order to receive a peg 54. For example, the block N may be included in partial row 122 and receive a peg 54 protruding from a block A in the aperture 186 (or some other block including a peg 54) in a row 132.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A building system comprising:

a plurality of blocks each having a hexahedral body having first and second side surfaces that are perpendicular to a common plane and define a subtended angle in the common plane;

a coupler extending outwardly from the first side surface, the receiver being sized to receive and removably retain the coupler; and a receiver extending inwardly from the second side surface into the hexahedral body, the receiver being sized to receive and removably retain the coupler;

wherein the subtended angles of the plurality of blocks are non-zero such that at least a portion of the plurality of blocks are positionable in a closed loop having the coupler of each block engaged with a receiver of an adjacent block;

the coupler of each block comprises an arm extending perpendicularly outward from the first side surface and a peg extending perpendicularly from a lower surface of the arm parallel to the common plane, the arm further defining an upper surface opposite and parallel to the lower surface;

the hexahedral body further includes a top surface parallel to the common plane and intersecting the first and second side surfaces;

the receiver comprises (a) a slot including (i) slot side surfaces extending into the hexahedral body perpendicular to the second side surface and perpendicular to the common plane ii) a slot bottom surface extending into the hexahedral body perpendicular to the second side surface and parallel to the common plane and (b) a hole extending inwardly from the slot bottom surface into the hexahedral body;

the arm and peg are sized such that the arm and peg are positionable within the slot and hole, respectively, of an adjacent block of the plurality of blocks having the upper surface of the arm flush with the top surface of the adjacent block;

wherein:

the plurality of blocks is a plurality of basic blocks, the system further comprising a plurality of A blocks, a plurality of B blocks, and a plurality of C blocks;

each A block comprises a hexahedral body having first and second side surfaces that are perpendicular to a common plane and define a subtended angle in the common plane;

a first coupler extending perpendicularly away from the first side surface, the first coupler being sized to removably insert within the receivers of the basic blocks; and a second coupler extending perpendicularly away from the second side surface;

each B block comprises a hexahedral body having first and second side surfaces that are perpendicular to a common plane and define a subtended angle in the common plane;

a first receiver extending into the hexahedral body perpendicular to the first side surface, the first receiver sized to removably receive the couplers second couplers of the A blocks, the first receiver having a B width parallel to the first side surface and common plane that is wider than a basic width of the receiver of the basic blocks parallel to the second side surface and common plane of the basic blocks;

a second receiver extending into the hexahedral body perpendicular to the second side surface, the second receiver sized to removably receive the couplers of the basic blocks and the first couplers of the A blocks; and each C block comprises a hexahedral body having first and second side surfaces that are perpendicular to a common plane and define a subtended angle in the common plane;

a coupler extending perpendicularly away from the first side surface, the coupler being sized to removably insert within the receivers of the basic blocks and the second couplers of the B blocks; and a receiver extending into the hexahedral body perpendicular to the second side surface, the receiver sized to removably receive the couplers of the basic blocks and the first couplers of the A blocks, the second receiver having a C width parallel to the second side surface and common plane that is wider than a basic width of the receiver of the basic blocks parallel to the second side surface and common plane of the basic blocks.

2. The building system of claim 1, wherein:

the basic and A blocks are shaped such that a first semi circular member may be formed including a first chain of basic blocks coupled to one another having one of the A blocks coupled to a first end of the first chain, such that the second coupler of the one of the A blocks and the coupler of the basic block at a second end of the first chain are exposed;

the basic, B, and C blocks are shaped such that a second semi circular member may be formed including a second chain of basic blocks coupled to one another having one of the C blocks coupled to a second end of the second chain and one of the B blocks coupled to a first end of the second chain, the one of the C blocks having the receiver thereof positioned to receive the coupler of the basic block at the second end of the first chain and the first receiver of the one of the B blocks positioned receive the second coupler of the one of the A blocks of the first semi circular member.

3. A building system comprising:

a plurality of blocks each having a hexahedral body having first and second side surfaces that are perpendicular to a common plane and define a subtended angle in the common plane;

a coupler extending outwardly from the first side surface, the receiver being sized to receive and removably retain the coupler; and a receiver extending inwardly from the second side surface into the hexahedral body, the receiver being sized to receive and removably retain the coupler;

wherein the subtended angles of the plurality of blocks are non-zero such that at least a portion of the plurality of blocks are positionable in a closed loop having the coupler of each block engaged with a receiver of an adjacent block;

the plurality of blocks is a plurality of basic blocks, the system further comprising a plurality of A blocks;

each A block comprises a hexahedral body having first and second side surfaces that are perpendicular to a common plane and define a subtended angle in the common plane;

a first coupling element including one of (a) a first coupler extending from the first side surface and sized to insert within the receivers of the basic blocks;

a second coupling element including a second coupler extending from the second side surface; and top and bottom surfaces parallel to the common plane and intersecting the first and second side surfaces, the top surface including a top coupling element and the bottom surface including a bottom coupling element configured to removably secure to the top coupling element.

4. The building system of claim 3, wherein the top coupling element is a hole extending into the hexahedral body of each A block and the bottom coupling element is a peg extending outwardly from the bottom surface of each A block.

5. A building system comprising:

a plurality of blocks each having a hexahedral body having first and second side surfaces that are perpendicular to a common plane and define a subtended angle in the common plane;

a coupler extending outwardly from the first side surface, the receiver being sized to receive and removably retain the coupler; and a receiver extending inwardly from the second side surface into the hexahedral body, the receiver being sized to receive and removably retain the coupler;

wherein the subtended angles of the plurality of blocks are non-zero such that at least a portion of the plurality of blocks are positionable in a closed loop having the coupler of each block engaged with a receiver of an adjacent block;

further comprising:

one or more core rods;

a plurality of D blocks, each comprising a body having first and second side surfaces that are perpendicular to a common plane and define a subtended angle in the common plane;

a first coupling element including one of (a) a first coupler extending from the first side surface (b) a first receiver extending into the first side surface;

a second coupling element including one of (a) a second coupler extending from the second side surface and (b) a second receiver extending into the second side surface; and a link coupler; and a plurality of core links defining a first aperture sized to receive the one or more core rods and a block coupler configured to removably secure to the link coupler of the D blocks.

6. The building system of claim 5, wherein:

the link coupler comprises a recess defined in the hexahedral body of each D block and a peg extending within the recess perpendicular to the common plane; and the block coupler comprises a hole sized to receive the peg of the link coupler.

7. The building system of claim 5 wherein the plurality of core rods each include a threaded end portion at a first end thereof and a threaded aperture at a second end thereof.

8. The building system of claim 7, wherein further comprising a starter link defining a threaded portion sized to threadably engage one of the threaded end portions and the threaded apertures of the core rods.

9. The building system of claim 7, further comprising a slant block comprising a first slant surface and a second slant surface opposite one another and defining a slant angle, the first slant surface defining a first slant coupling element and the second slant surface defining a second slant coupling element.

10. The building system of claim 9 wherein:

the first slant coupling element is a threaded peg protruding from the first slant surface and sized to engage the threaded apertures of the plurality of core rods; and the second slant coupling element is a threaded hole extending into the slant block from the second slant surface and sized to engage the threaded end portions of the plurality of core rods.

11. A method for building comprising:

providing a plurality of blocks each having a hexahedral body having first and second side surfaces that are perpendicular to a common plane and define a subtended angle in the common plane;

a coupler extending away from the hexahedral body perpendicular to the first side surface, the receiver being sized to receive and removably retain the coupler; and a receiver extending into the hexahedral body perpendicular to the second side surface forming a plurality of closed loops each comprising a portion of the plurality of blocks, each block of the portion having the coupler thereof retained within the receiver of an adjacent block of the portion, the portion of the plurality of blocks including a second plurality of blocks having the subtended angle in the common plane being greater than zero;

securing the plurality of closed loops in a stacked configuration to form an object having a contoured outer surface for each loop of the plurality of loops, securing a core link to at least one block of the portion of the plurality of blocks of each loop;

inserting a core rod through core apertures of the core links secured to each loop of the plurality of loops.

* * * * *